US012421947B2

(12) United States Patent
Wagner et al.

(10) Patent No.: US 12,421,947 B2
(45) Date of Patent: Sep. 23, 2025

(54) ACTUATOR FOR A RECIPROCATING PUMP

(71) Applicant: SPM Oil & Gas Inc., Fort Worth, TX (US)

(72) Inventors: Bryan C. Wagner, Aledo, TX (US); Edward Charles Kotapish, Willow Park, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 626 days.

(21) Appl. No.: 17/268,393

(22) PCT Filed: Aug. 16, 2019

(86) PCT No.: PCT/US2019/046939
§ 371 (c)(1),
(2) Date: Feb. 12, 2021

(87) PCT Pub. No.: WO2020/037283
PCT Pub. Date: Feb. 20, 2020

(65) Prior Publication Data

US 2021/0190053 A1 Jun. 24, 2021

Related U.S. Application Data

(60) Provisional application No. 62/753,677, filed on Oct. 31, 2018, provisional application No. 62/719,478, filed on Aug. 17, 2018.

(51) Int. Cl.

| | |
|---|---|
| ***F04B 19/22*** | (2006.01) |
| ***F04B 9/00*** | (2006.01) |
| ***F04B 49/06*** | (2006.01) |

(52) U.S. Cl.
CPC ..... *F04B 19/22* (2013.01); *F04B 9/00* (2013.01); *F04B 49/06* (2013.01)

(58) Field of Classification Search
CPC ..... F04B 9/00; F04B 19/22; F04B 49/06
See application file for complete search history.

(56) References Cited

U.S. PATENT DOCUMENTS

| | | | | |
|---|---|---|---|---|
| 4,518,317 A | | 5/1985 | Inoue | |
| 4,990,058 A | * | 2/1991 | Eslinger | F04B 9/113 417/18 |
| 5,693,991 A | * | 12/1997 | Hiterer | F02G 1/0435 62/6 |
| 6,749,408 B1 | * | 6/2004 | Eilertsen | F04B 9/02 417/415 |

(Continued)

OTHER PUBLICATIONS

International Search Report and Written Opinion dated Nov. 7, 2019 for PCT/US19/46939, 10 pages.

*Primary Examiner* — Connor J Tremarche

(57) ABSTRACT

A reciprocating pump assembly includes a fluid end section having a pressure chamber and a plunger bore that fluidly communicates with the pressure chamber. The reciprocating pump assembly includes a plunger configured to be held within the plunger bore of the fluid end section, and a linear actuator operatively connected to the plunger such that the linear actuator is configured to reciprocate the plunger within the plunger bore during operation of the reciprocating pump to thereby pump fluid through the fluid end section.

14 Claims, 8 Drawing Sheets

(56) References Cited

U.S. PATENT DOCUMENTS

| | | | | |
|---|---|---|---|---|
| 7,556,480 | B2 * | 7/2009 | Eilertsen | F04B 9/02 417/415 |
| 2004/0103376 | A1 * | 5/2004 | Pandey | G06F 3/0483 715/251 |
| 2011/0020155 | A1 * | 1/2011 | Reukers | F04B 49/06 417/415 |
| 2011/0286867 | A1 * | 11/2011 | Lesko | F04B 15/02 92/140 |
| 2013/0277584 | A1 * | 10/2013 | McKernan | B66F 9/22 251/129.01 |
| 2016/0146201 | A1 | 5/2016 | Van Keulen | |
| 2016/0160848 | A1 * | 6/2016 | Toppings | F04B 7/0088 417/559 |
| 2016/0273556 | A1 * | 9/2016 | Tsai | F15B 15/1447 |
| 2016/0363116 | A1 * | 12/2016 | Gregory | E21B 43/126 |
| 2017/0370524 | A1 | 12/2017 | Wagner | |

* cited by examiner

ACTUATOR FOR A RECIPROCATING PUMP

CROSS-REFERENCE TO RELATED APPLICATION

This application is filed under 35 U.S.C. 371, and claims the benefit of and priority to PCT/US2019/046939, having a filing date of Aug. 16, 2019, entitled "ACTUATOR FOR A RECIPROCATING PUMP," which claims the benefit of and priority to U.S. Provisional Patent Application No. 62/719,478 having a filing date of Aug. 17, 2018, and U.S. Provisional Patent Application No. 62/753,677 having a filing date of Oct. 31, 2018, all of which are hereby incorporated by reference in their entirety for all purposes.

TECHNICAL FIELD

This disclosure relates to reciprocating pumps, and, in particular, to actuators for reciprocating pumps.

BACKGROUND

In oilfield operations, reciprocating pumps are used for different applications such as fracturing subterranean formations to drill for oil or natural gas, cementing the wellbore, or treating the wellbore and/or formation. A reciprocating pump designed for fracturing operations is sometimes referred to as a 'frac pump._ A reciprocating pump typically includes a power end section and a fluid end section. The fluid end section can be formed of a one piece construction or a series of blocks secured together by rods. The fluid end section includes a fluid cylinder (sometimes referred to as a cylinder section or a fluid end block) having a plunger bore for receiving a plunger, an inlet fluid passage, and an outlet fluid passage (sometimes referred to as a discharge passage). The inlet and outlet passages each include a valve assembly to control the flow of fluid into and out of the fluid cylinder. For example, the valve assemblies can be differential pressure valves that are opened by differential pressure of fluid and allow the fluid to flow in only one direction through the corresponding inlet or outlet passage.

During operation of a reciprocating pump, rotation of a crankshaft of the power end section reciprocates the plunger within the plunger bore of the fluid end section to thereby pump fluid into the fluid cylinder through the inlet passage and out through the outlet passage. But, the crankshaft provides the plunger with a relatively short stroke length that increases the cyclical rate of the reciprocating pump. Accordingly, the valve assemblies experience a relatively large number of sealing events during operation of the reciprocating pump, which increases wear on the valve assemblies. Moreover, at least some known reciprocating pumps experience non-uniform flow rates. For example, at least some known reciprocating pumps experience flow rate surges, which for example may be undesirable during fracking operations.

SUMMARY

This summary is provided to introduce a selection of concepts in a simplified form that are further described below in the Detailed Description. This summary is not intended to identify key features or essential features of the claimed subject matter. Nor is it intended to be used as an aid in determining the scope of the claimed subject matter.

In a first aspect, a reciprocating pump assembly includes a fluid end section having a pressure chamber and a plunger bore that fluidly communicates with the pressure chamber. The reciprocating pump assembly includes a plunger configured to be held within the plunger bore of the fluid end section, and a linear actuator operatively connected to the plunger such that the linear actuator is configured to reciprocate the plunger within the plunger bore during operation of the reciprocating pump to thereby pump fluid through the fluid end section.

In some embodiments, the linear actuator includes at least one of a mechanical linear actuator, an electrical linear actuator, an electro-mechanical linear actuator, a magnetic linear actuator, a hydraulic linear actuator, a pneumatic linear actuator, a screw-type actuator, a ball screw, a lead screw, a rotary screw, a screw jack, a roller screw, a hydraulic piston, a linear motor, a wheel and axle actuator, a telescoping linear actuator, a solenoid, or a servo.

In some embodiments, the reciprocating pump assembly includes a driver configured to drive operation of the linear actuator. The driver includes at least one of an engine, an electrical motor, a turbine, a hydraulic pump, a pneumatic pump, a mechanical pump, an electrical power source, an electrical circuit, a processor, a mechanical drive system, a pneumatic system, or a hydraulic system.

In some embodiments, the reciprocating pump assembly includes a power end section that includes the linear actuator.

In some embodiments, the reciprocating pump assembly includes a controller operatively connected to the linear actuator such that the controller is configured to electronically control a flow rate of fluid through the fluid end section.

In a second aspect, a reciprocating pump assembly includes a first fluid end section having a first pressure chamber and a first plunger bore that fluidly communicates with the first pressure chamber. The reciprocating pump assembly includes a first plunger rod assembly that includes a first plunger configured to be held within the first plunger bore of the first fluid end section. The reciprocating pump assembly includes a second fluid end section having a second pressure chamber and a second plunger bore that fluidly communicates with the second pressure chamber. The reciprocating pump assembly includes a second plunger rod assembly that includes a second plunger configured to be held within the second plunger bore of the second fluid end section. The reciprocating pump assembly includes at least one linear actuator operatively connected to the first and second plunger rod assemblies such that the at least one linear actuator is configured to reciprocate the first and second plungers within the first and second plunger bores, respectively, during operation of the reciprocating pump to thereby pump fluid through the first and second fluid end sections.

In some embodiments, the at least one linear actuator includes at least one of a mechanical linear actuator, an electrical linear actuator, an electro-mechanical linear actuator, a magnetic linear actuator, a hydraulic linear actuator, a pneumatic linear actuator, a screw-type actuator, a ball screw, a lead screw, a rotary screw, a screw jack, a roller screw, a hydraulic piston, a linear motor, a wheel and axle actuator, a telescoping linear actuator, a solenoid, or a servo.

In some embodiments, the reciprocating pump assembly includes at least one driver configured to drive operation of the at least one linear actuator. The driver includes at least one of an engine, an electrical motor, a turbine, a hydraulic pump, a pneumatic pump, a mechanical pump, an electrical power source, an electrical circuit, a processor, a mechanical drive system, a pneumatic system, or a hydraulic system.

In some embodiments, the reciprocating pump assembly includes a power end section that includes the at least one linear actuator.

In some embodiments, at least one of the first fluid end section includes only a single one of the first pressure chamber or the second fluid end section includes only a single one of the second pressure chamber.

In some embodiments, the first and second plunger rod assemblies are operatively connected to the at least one linear actuator such that the first and second plunger rod assemblies are coaxially aligned with each other.

In some embodiments, the at least one linear actuator is configured to simultaneously move the first and second plunger rod assemblies in the same direction.

In some embodiments, the at least one linear actuator is configured to simultaneously move the first and second plunger rod assemblies in opposite directions.

In some embodiments, the at least one linear actuator is at least one first linear actuator. The reciprocating pump assembly includes a third fluid end section having a third pressure chamber and a third plunger bore that fluidly communicates with the third pressure chamber. The reciprocating pump assembly includes a third plunger rod assembly that includes a third plunger configured to be held within the third plunger bore of the third fluid end section. The reciprocating pump assembly includes a fourth fluid end section having a fourth pressure chamber and a fourth plunger bore that fluidly communicates with the fourth pressure chamber. The reciprocating pump assembly includes a fourth plunger rod assembly that includes a fourth plunger configured to be held within the fourth plunger bore of the fourth fluid end section. The reciprocating pump assembly includes at least one second linear actuator operatively connected to the third and fourth plunger rod assemblies such that the at least one second linear actuator is configured to reciprocate the third and fourth plungers within the third and fourth plunger bores, respectively, during operation of the reciprocating pump to thereby pump fluid through the third and fourth fluid end sections.

In some embodiments, the reciprocating pump assembly includes a controller operatively connected to the at least one linear actuator such that the controller is configured to electronically control a flow rate of fluid through the first and second fluid end sections.

In some embodiments, the at least one linear actuator is at least one first linear actuator. The reciprocating pump assembly includes a third fluid end section having a third pressure chamber and a third plunger bore that fluidly communicates with the third pressure chamber. The reciprocating pump assembly includes a third plunger rod assembly that includes a third plunger configured to be held within the third plunger bore of the third fluid end section. The reciprocating pump assembly includes a fourth fluid end section having a fourth pressure chamber and a fourth plunger bore that fluidly communicates with the fourth pressure chamber. The reciprocating pump assembly includes a fourth plunger rod assembly that includes a fourth plunger configured to be held within the fourth plunger bore of the fourth fluid end section. The reciprocating pump assembly includes at least one second linear actuator operatively connected to the third and fourth plunger rod assemblies such that the at least one second linear actuator is configured to reciprocate the third and fourth plungers within the third and fourth plunger bores, respectively, during operation of the reciprocating pump to thereby pump fluid through the third and fourth fluid end sections. The reciprocating pump assembly includes a controller operatively connected to the at least one first linear actuator and the at least one second linear actuator such that the controller is configured to offset the duty cycle of the first and second fluid end sections from the duty cycle of the third and fourth fluid end sections.

In a third aspect, a method for operating a reciprocating pump assembly includes operatively connecting at least one linear actuator to a first plunger rod assembly of a first fluid end section having a first plunger bore; operatively connecting the at least one linear actuator to a second plunger rod assembly of a second fluid end section having a second plunger bore; and reciprocating respective first and second plungers of the first and second plunger rod assemblies within the first and second plunger bores, respectively, using the at least one linear actuator to pump fluid through the first and second fluid end sections.

In some embodiments, reciprocating the first and second plungers within the first and second plunger bores, respectively, using the at least one linear actuator includes simultaneously moving the first and second plunger rod assemblies in the same direction.

In some embodiments, reciprocating the first and second plungers within the first and second plunger bores, respectively, using the at least one linear actuator includes electronically controlling a flow rate of fluid through the first and second fluid end sections.

In some embodiments, the at least one linear actuator is at least one first linear actuator. The method further includes operatively connecting at least one second linear actuator to a third plunger rod assembly of a third fluid end section having a third plunger bore; operatively connecting the at least one second linear actuator to a fourth plunger rod assembly of a fourth fluid end section having a fourth plunger bore; reciprocating respective third and fourth plungers of the third and fourth plunger rod assemblies within the third and fourth plunger bores, respectively, using the at least one second linear actuator to pump fluid through the third and fourth fluid end sections; and offsetting the duty cycle of the first and second fluid end sections from the duty cycle of the third and fourth fluid end sections.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

The accompanying drawings facilitate an understanding of the various embodiments.

Corresponding reference characters indicate corresponding parts throughout the drawings.

DETAILED DESCRIPTION

Figure 1:
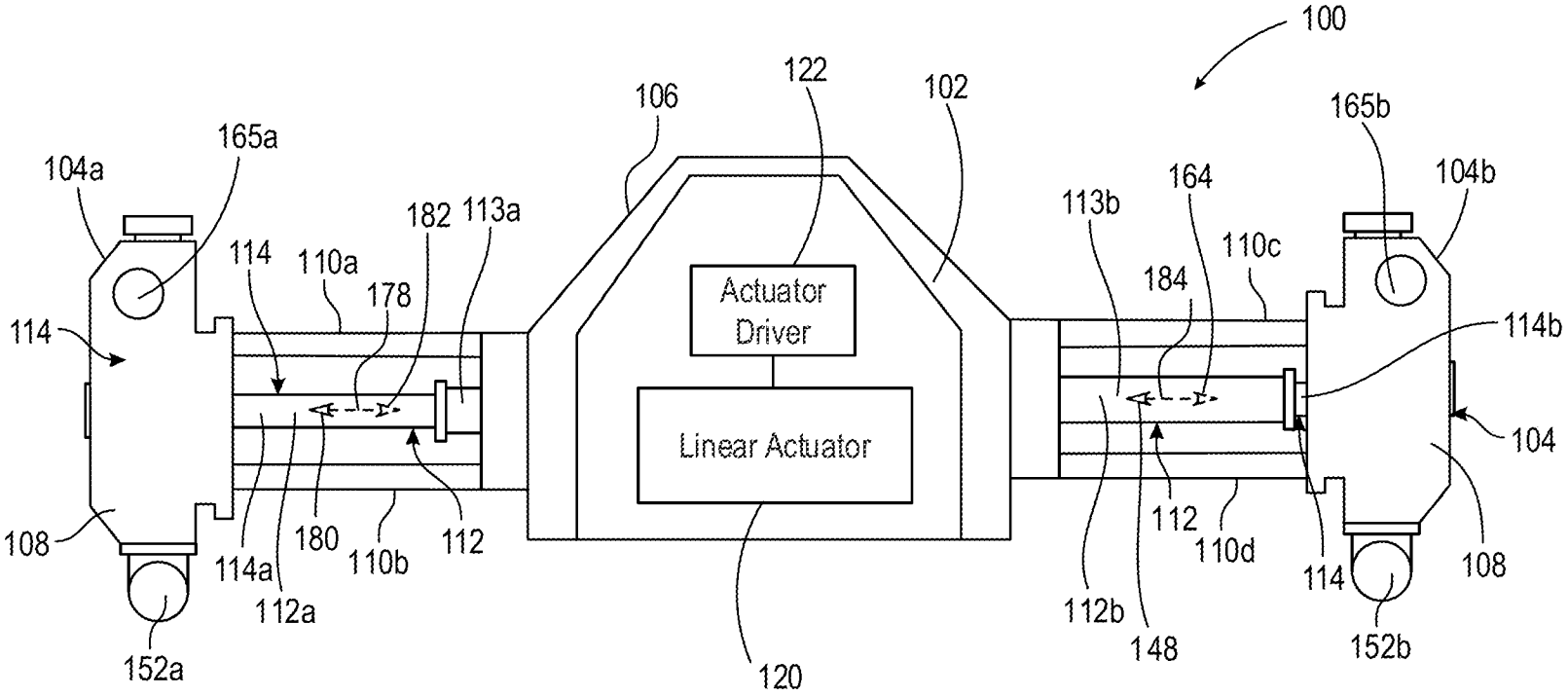
FIG. 1 is an elevational view of a reciprocating pump assembly according to an exemplary embodiment.

Certain embodiments of the disclosure provide a reciprocating pump assembly that includes a fluid end section having a pressure chamber and a plunger bore that fluidly communicates with the pressure chamber. The reciprocating pump assembly includes a plunger configured to be held within the plunger bore of the fluid end section, and a linear actuator operatively connected to the plunger such that the linear actuator is configured to reciprocate the plunger within the plunger bore during operation of the reciprocating pump to thereby pump fluid through the fluid end section.

Certain embodiments of the disclosure provide a reciprocating pump assembly includes a first fluid end section having a first pressure chamber and a first plunger bore that fluidly communicates with the first pressure chamber. The reciprocating pump assembly includes a first plunger rod assembly that includes a first plunger configured to be held within the first plunger bore of the first fluid end section. The reciprocating pump assembly includes a second fluid end section having a second pressure chamber and a second plunger bore that fluidly communicates with the second pressure chamber. The reciprocating pump assembly includes a second plunger rod assembly that includes a second plunger configured to be held within the second plunger bore of the second fluid end section. The reciprocating pump assembly includes at least one linear actuator operatively connected to the first and second plunger rod assemblies such that the at least one linear actuator is configured to reciprocate the first and second plungers within the first and second plunger bores, respectively, during operation of the reciprocating pump to thereby pump fluid through the first and second fluid end sections.

Certain embodiments of the disclosure provide a method for operating a reciprocating pump assembly includes operatively connecting at least one linear actuator to a first plunger rod assembly of a first fluid end section having a first plunger bore; operatively connecting the at least one linear actuator to a second plunger rod assembly of a second fluid end section having a second plunger bore; and reciprocating respective first and second plungers of the first and second plunger rod assemblies within the first and second plunger bores, respectively, using the at least one linear actuator to pump fluid through the first and second fluid end sections.

Certain embodiments of the disclosure increase the stroke length of the plunger of the fluid end section of a reciprocating pump assembly and thereby reduce the number of sealing events experienced by valve assemblies of the fluid end section during operation of the reciprocating pump assembly. Certain embodiments of the disclosure increase the longevity of the valve assemblies of a fluid end section of a reciprocating pump assembly and thereby reduce the operating costs of a reciprocating pump assembly. Certain embodiments of the disclosure provide a relatively steady flow of fluid (e.g., a relatively uniform flow rate, a relatively constant flow rate, a relatively consistent flow rate, etc.) through a fluid end section of a reciprocating pump assembly. Certain embodiments of the disclosure may reduce flow rate surges of a reciprocating pump assembly.

Referring to FIG. 1, an illustrative embodiment of a reciprocating pump assembly 100 is presented. The reciprocating pump assembly 100 includes a power end section 102 and a pair of fluid end sections 104 operably coupled thereto. Specifically, the reciprocating pump assembly 100 includes a fluid end section 104*a* operably coupled to the power end section 102 and a fluid end section 104*b* operably coupled to the power end section 102. The power end section 102 includes a housing 106 in which a linear actuator 120 is disposed. Each of the fluid end sections 104*a* and 104*b* includes a fluid cylinder 108 (sometimes referred to as a 'fluid end block_ or a 'cylinder section_), which in the exemplary embodiments is connected to the housing 106 via a plurality of stay rods 110*a*, 110*b*, 110*c*, and 110*d*. Other structures may be used to connect the fluid end section 104 to the housing 106 in addition or alternatively to the stay rods 110*a*, 110*b*, 110*c*, and/or 110*d*.

The linear actuator 120 is operatively connected to plungers 114 of the plunger rod assemblies 112. Specifically, the linear actuator 120 is operatively connected to a plunger 114*a* of a plunger rod assembly 112*a* via a plunger rod 113*a*; and the linear actuator 120 is operatively connected to a plunger 114*b* of a plunger rod assembly 112*b* via a plunger rod 113*b*. In operation, the linear actuator 120 reciprocates plunger rod assemblies 112 between the power end section 102 and the fluid end sections 104*a* and 104*b* to thereby pump (i.e., move) fluid through the fluid cylinders 108 of the fluid end sections 104*a* and 104*b*, as will be described in more detail below.

According to some embodiments, the reciprocating pump assembly 100 is freestanding on the ground, mounted to a trailer for towing between operational sites, mounted to a skid, loaded on a manifold, otherwise transported, and/or the like. The reciprocating pump assembly 100 is not limited to frac pumps. Rather, the embodiments disclosed herein may be used with any other type of pump that includes a plunger rod assembly.

Figure 2:
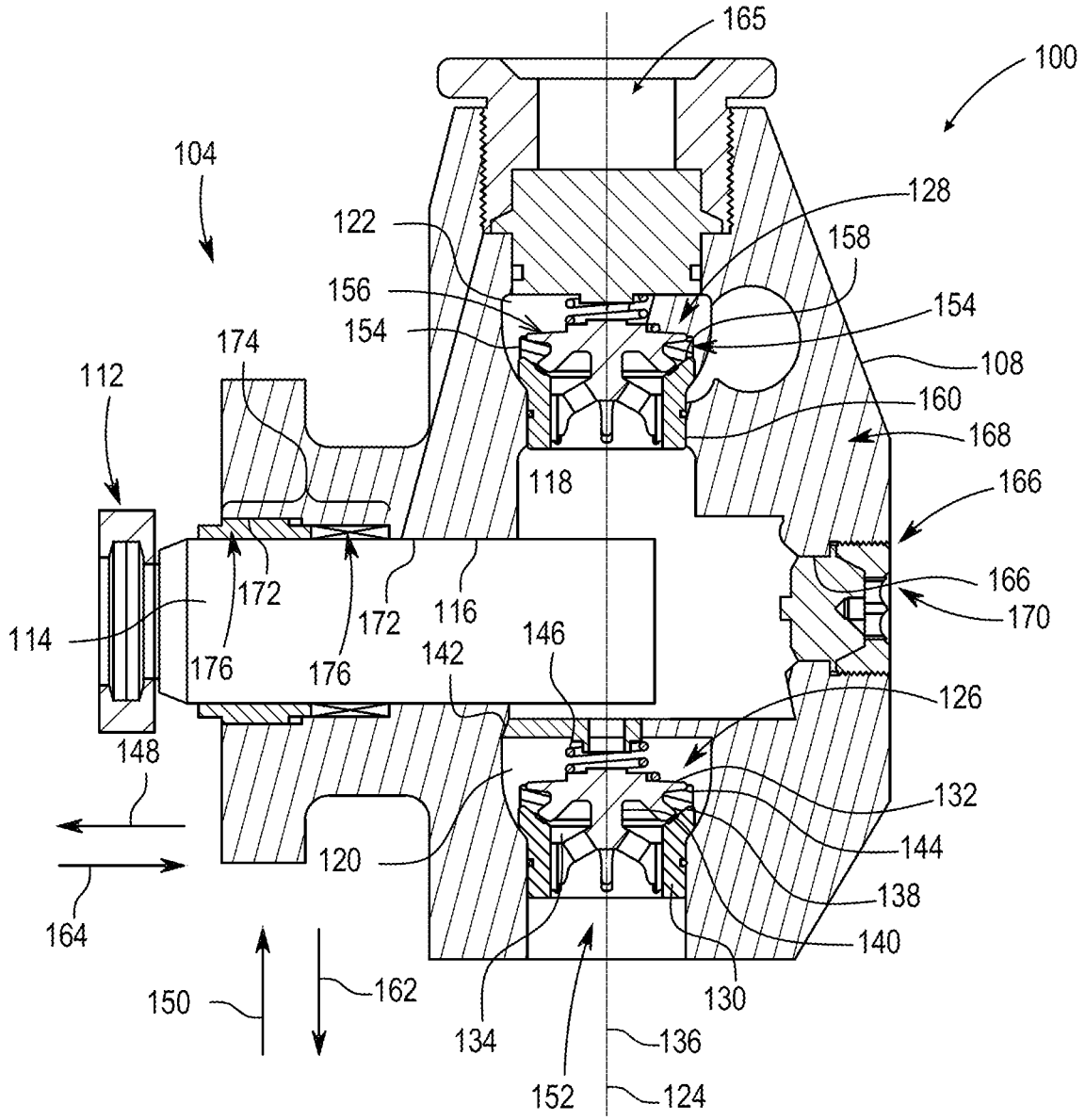
FIG. 2 is a cross-sectional view of a fluid end section of the reciprocating pump assembly shown in FIG. 1 according an exemplary embodiment.

FIG. 2 illustrates one of the fluid end sections 104 (e.g., the fluid end section 104*a*, the fluid end section 104*b*, etc.) of the reciprocating pump assembly 100 according to an exemplary embodiment. Referring now to FIG. 2, the fluid cylinder 108 of the fluid end section 104 includes a pressure chamber 118 and a plunger bore 116 that fluidly communicates with the pressure chamber 118. The plunger 114 of the plunger rod assembly 112 is held within (e.g., extends through, etc.) the plunger bore 116 such that the plunger 114 extends into the pressure chamber 118. At least the plunger bore 116, the pressure chamber 118, and the plunger 114 together may be characterized as a 'plunger throw._ According to some embodiments, the reciprocating pump assembly 100 includes three plunger throws (i.e., a triplex pump assembly); however, in other embodiments, the reciprocating pump assembly 100 includes a greater or fewer number of plunger throws (e.g., only a single plunger throw, etc.).

As shown in FIG. 2, the fluid cylinder 108 includes inlet and outlet fluid passages 120 and 122, respectively, formed therein. Optionally, the inlet and outlet fluid passages 120 and 122, respectively, are coaxially disposed along a fluid passage axis 124, for example as is shown in FIG. 2. Fluid is adapted to flow through the inlet and outlet fluid passages 120 and 122, respectively, and along the fluid passage axis 124. An inlet valve assembly 126 is disposed in the inlet fluid passage 120 and an outlet valve assembly 128 is disposed in the outlet fluid passage 122. In the exemplary embodiments, the valve assemblies 126 and 128 are spring-loaded, which, as described in greater detail below, are actuated by at least a predetermined differential pressure across each of the valve assemblies 126 and 128.

The inlet valve assembly 126 includes a valve seat 130 and a valve member 132 that is configured to be sealingly engaged therewith. The valve seat 130 includes an inlet valve bore 134 that extends along a valve seat axis 136 that is coaxial with the fluid passage axis 124 when the inlet valve assembly 126 is disposed in the inlet fluid passage 120. The valve seat 130 further includes a shoulder 138, which in the exemplary embodiment is tapered (i.e., extends at an oblique angle relative to the valve seat axis 136). In some other examples, the shoulder 138 of the valve seat 130 extends approximately perpendicular to the valve seat axis 136.

The valve member 132 includes a valve head 142 and a tail segment 140 extending from the valve head 142. As shown in FIG. 2, the tail segment 140 is received within the inlet valve bore 134 of the valve seat 130 when the inlet valve assembly 126 is assembled as shown. The valve head 142 includes a seal 144. The valve head 142 of the valve member 132 is moveable relative to the valve seat 130 along the valve seat axis 136 between an open position and a closed position. In the closed position of the valve member 132, the seal 144 of the valve head 142 sealingly engages the valve seat 130 to prevent fluid flow through the inlet valve assembly 126. In the exemplary embodiments, the valve member 132 is engaged and otherwise biased by a spring 146, which, as discussed in greater detail below, biases the valve member 132 to the closed position.

According to certain embodiments, at least a portion of the valve seat 130 and/or at least a portion of the valve head 142 is formed from stainless steel. But, the valve seat 130 and/or the valve head 142 may be formed from any other material in addition or alternative to stainless steel. Although shown herein as being a helical (i.e., coil) compression spring, additionally or alternatively the spring 146 can include any type of spring, such as, but not limited to, a flat spring, a machined spring, a serpentine spring, a torsion spring, a tension spring, a constant spring, a variable spring, a variable stiffness spring, a leaf spring, a cantilever spring, a volute spring, a v-spring, and/or the like.

In the embodiments illustrated herein, the outlet valve assembly 128 is substantially similar to the inlet valve assembly 126 and therefore will not be described in further detail herein.

In operation, the plunger 114 reciprocates within the plunger bore 116 for movement into and out of the pressure chamber 118. That is, the plunger 114 moves back and forth horizontally, as viewed in FIG. 2, away from and towards the fluid passage axis 124. As will be described below, the linear actuator 120 (FIG. 1) moves the plunger 114 toward and away from the fluid passage axis 124. Movement of the plunger 114 in the direction of arrow 148 away from the fluid passage axis 124 and out of the pressure chamber 118 will be referred to herein as the suction stroke of the plunger 114. As the plunger 114 moves along the suction stroke, the inlet valve assembly 126 is opened to the open position of the valve member 132. More particularly, as the plunger 114 moves away from the fluid passage axis 124 in the direction of arrow 148, the pressure inside the pressure chamber 118 decreases, creating a differential pressure across the inlet valve assembly 126 and causing the valve head 142 of the valve member 132 to move (relative to the valve seat 130) upward, as viewed in FIG. 2, along the valve seat axis 136 in the direction of arrow 150. As a result of the upward movement of the valve head 142 of the valve member 132 along the valve seat axis 136, the spring 146 is compressed and the valve head 142 of the valve member 132 separates from the shoulder 138 of the valve seat 130 to move the valve member 132 to the open position. In the open position of the valve member 132, fluid entering through an inlet 152 of the inlet fluid passage 120 flows along the fluid passage axis 124 and through the inlet valve assembly 126, being drawn into the pressure chamber 118. To flow through the inlet valve assembly 126, the fluid flows through the inlet valve bore 134 and along the valve seat axis 136. The inlet 152 defines a suction port of the fluid end section 104.

During the fluid flow through the inlet valve assembly 126 and into the pressure chamber 118, the outlet valve assembly 128 is in a closed position wherein a seal 154 of a valve member 156 of the outlet valve assembly 128 is sealingly engaged with a shoulder 158 of a valve seat 160 of the outlet valve assembly 128. Fluid continues to be drawn into the pressure chamber 118 until the plunger 114 is at the end of the suction stroke of the plunger 114, wherein the plunger 114 is at the farthest point from the fluid passage axis 124 of the range of motion of the plunger 114.

At the end of the suction stroke of the plunger 114, the differential pressure across the inlet valve assembly 126 is such that the spring 146 of the inlet valve assembly 126 begins to decompress and extend, forcing the valve head 142 of the valve member 132 of the inlet valve assembly 126 to move (relative to the valve seat 130) downward, as viewed in FIG. 2, along the valve seat axis 136 in the direction of arrow 162. As a result, the inlet valve assembly 126 moves to the closed position of the valve member 132 wherein the valve head 142 of the valve member 132 is sealingly engaged with the valve seat 130.

Movement of the plunger 114 in the direction of arrow 164 toward the fluid passage axis 124 and into the pressure chamber 118 will be referred to herein as the discharge stroke of the plunger 114. As the plunger 114 moves along the discharge stroke into the pressure chamber 118, the pressure within the pressure chamber 118 increases. The pressure within the pressure chamber 118 increases until the differential pressure across the outlet valve assembly 128 exceeds a predetermined set point, at which point the outlet valve assembly 128 opens and permits fluid to flow out of the pressure chamber 118 along the fluid passage axis 124, being discharged through an outlet 165 of the fluid end section 104. During the discharge stroke of the plunger 114, the valve member 132 of the inlet valve assembly 126 is positioned in the closed position wherein the valve head 142 of the valve member 132 is sealingly engaged with the valve seat 130. The outlet 165 of the fluid end section 104 defines a discharge port of the fluid end section 104.

The fluid cylinder 108 of the fluid end section 104 of the reciprocating pump assembly 100 includes an access port 166. The access port 166 is defined by an opening that extends through a body 168 of the fluid cylinder 108 to provide access to the pressure chamber 118 and thereby internal components of the fluid cylinder 108 (e.g., the inlet valve assembly 126, the outlet valve assembly 128, the plunger 114, etc.) for service (e.g., maintenance, replacement, etc.) thereof. The access port 166 of the fluid cylinder 108 is closed using a suction cover assembly 170 to seal the pressure chamber 118 of the fluid cylinder 108 at the access port 166.

The plunger bore 116 is defined by an inner wall 172 of the body 168 of the fluid cylinder 108. In other words, the plunger bore 116 includes the inner wall 172. As shown in FIG. 2, the plunger bore 116 includes a packing segment 174. The plunger rod assembly 112 includes packing 176 that is received within the packing segment 174 of the plunger bore 116 such that the packing 176 extends radially between the plunger 114 and the inner wall 172 to facilitate sealing the plunger 114 within the plunger bore 116 of the fluid cylinder 108.

The illustrated fluid end section 104 is but one example of a fluid end section that may be operably coupled to the power end section 102 (FIG. 1) of the reciprocating pump assembly 100. Other fluid end sections may additionally or alternatively be used. For example, the fluid end section 104 shown in FIG. 2 includes only a single one of the pressure chamber 118. In other embodiments, one or more of the fluid end sections disclosed herein includes two or more pressure chambers such that the fluid end section(s) provides a manifold having multiple suction and discharge ports.

Referring again to FIG. 1, and as briefly described above, the linear actuator 120 is operatively connected to the plunger 114*a* of the plunger rod assembly 112*a* via the plunger rod 113*a* such that the linear actuator 120 is configured to reciprocate the plunger 114*a* within the plunger bore 116 (FIG. 2) of the fluid end section 104*a* during operation of the reciprocating pump assembly 100 to thereby pump fluid through the fluid end section 104*a*. Specifically, the linear actuator 120 is configured to move the plunger rod 113*a* along an axis 178 in two opposite directions 180 and 182 toward and away, respectively, from the fluid end section 104*a*, as is shown in FIG. 1. Accordingly, the linear actuator 120 is configured to move the plunger 114*a* along the axis 178 in the opposite directions 180 and 182 to thereby reciprocate the plunger 114*a* within the plunger bore 116 along the axis 178. Movement of the plunger 114*a* along the axis 178 in the direction 182 draws fluid into a suction port 152*a* of the fluid end section 104*a*, while movement of the plunger 114*a* along the axis 178 in the direction 180 discharges fluid through a discharge port 165*a* of the fluid end section 104*a*. Accordingly, the linear actuator 120 is configured to pump fluid through the fluid end section 104*a* by reciprocating the plunger 114*a* within the plunger bore 116 of the fluid end section 104*a*.

As is also briefly described above, the linear actuator 120 is operatively connected to the plunger 114*b* of the plunger rod assembly 112*b* via the plunger rod 113*b* such that the linear actuator 120 is configured to reciprocate the plunger 114*b* within the plunger bore 116 of the fluid end section 104*b* during operation of the reciprocating pump assembly 100 to thereby pump fluid through the fluid end section 104*b*. Specifically, the linear actuator 120 is configured to move the plunger rod 113*b* along an axis 184 in two opposite directions 164 and 148 toward and away, respectively, from the fluid end section 104*b*. The linear actuator 120 thus is configured to move the plunger 114*b* along the axis 184 in the opposite directions 148 and 164 to thereby reciprocate the plunger 114*b* within the plunger bore 116 along the axis 184. Movement of the plunger 114*b* along the axis 184 in the direction 148 draws fluid into a suction port 152*b* of the fluid end section 104*a*, while movement of the plunger 114*b* along the axis 184 in the direction 164 discharges fluid through a discharge port 165*b* of the fluid end section 104*b*. Accordingly, the linear actuator 120 is configured to pump fluid through the fluid end section 104*b* by reciprocating the plunger 114*b* within the plunger bore 116 of the fluid end section 104*b*.

In the exemplary embodiment, the axes 178 and 184 are aligned with each other such that the plunger rod assemblies 112*a* and 112*b* are coaxially aligned with each other. In other embodiments, the axes 178 are not aligned with each other such that the plunger rod assemblies 112*a* and 112*b* are not coaxially aligned. Moreover, the exemplary embodiment illustrates an embodiment wherein the linear actuator 120: (1) moves the plunger rod assembly 112*a* in the direction 182 to draw fluid into the fluid end section 104*a* while simultaneously moving the plunger rod assembly 112*b* in the direction 164 to discharge fluid from the fluid end section 104*b*; and (2) moves the plunger rod assembly 112*a* in the direction 180 to discharge fluid from the fluid end section 104*a* while simultaneously moving the plunger rod assembly 112*b* in the direction 148 to draw fluid into the fluid end section 104*b*. In other words, in the exemplary embodiment the linear actuator 120 simultaneously moves the plunger rod assemblies 112*a* and 112*b* in the same direction. In other embodiments, the linear actuator 120 simultaneously moves the plunger rod assemblies 112*a* and 112*b* in opposite directions (i.e., the plunger rod assemblies 112*a* and 112*b* are moved in reciprocal synchronization). Specifically, in some other embodiments, the linear actuator 120: (1) moves the plunger rod assembly 112*a* in the direction 182 to draw fluid into the fluid end section 104*a* while simultaneously moving the plunger rod assembly 112*b* in the direction 148 to draw fluid into the fluid end section 104*b*; and (2) moves the plunger rod assembly 112*a* in the direction 180 to discharge fluid from the fluid end section 104*a* while simultaneously moving the plunger rod assembly 112*b* in the direction 164 to discharge fluid from the fluid end section 104*b*.

Although the exemplary embodiment illustrates a single linear actuator 120 that moves both the plunger rod assembly 112*a* and the plunger rod assembly 112*b*, other embodiments may include two or more linear actuators 120. For example, the reciprocating pump assembly 100 may include a first linear actuator 120 that is operatively connected to the plunger rod assembly 112*a* for reciprocating the plunger 114*a* within the plunger bore 116 of the fluid end section 104*a* and a second linear actuator 120 that is operatively connected to the plunger rod assembly 112*b* for reciprocating the plunger 114*b* within the plunger bore 116 of the fluid end section 104*b*. In another example, the reciprocating pump assembly 100 includes a first linear actuator 120 that is operatively connected to the plunger rod assemblies 112*a* and 112*b* for moving the plungers 114*a* and 114*b* in the respective directions 182 and 164 and a second linear actuator 120 that is operatively connected to the plunger rod assemblies 112*a* and 112*b* for moving the plungers 114*a* and 114*b* in the respective directions 180 and 148.

In the exemplary embodiment, the linear actuator 120 is housed within the housing 106 of the power end section 102 of the reciprocating pump assembly 100 such that the power end section 102 includes the linear actuator 120. But, the linear actuator 120 additionally or alternatively may be: (1) housed within the fluid end section 104*a*; (2) housed within the fluid end section 104*b*; and/or (3) positioned external to the power end section 102, the fluid end section 104*a*, and/or the fluid end section 104*b*.

Each linear actuator 120 may include any type of linear actuator, such as, but not limited to, a mechanical linear actuator, an electrical linear actuator, an electro-mechanical linear actuator, a magnetic linear actuator, a hydraulic linear actuator, a pneumatic linear actuator, a screw-type actuator, a ball screw, a lead screw, a rotary screw, a screw jack, a roller screw, a hydraulic piston, a linear motor, a wheel and axle actuator, a telescoping linear actuator, a solenoid, and/or a servo.

In some embodiments, an actuator driver 122 is operatively connected to the linear actuator 120 for controlling and/or driving (e.g., powering, etc.) operation of the linear actuator 120. The actuator driver 122 may include any type of driver, such as, but not limited to, an engine, an electrical motor, a turbine, a hydraulic pump (e.g., hydrostatic, hydrodynamic, etc.), a pneumatic pump, a mechanical pump, an electrical power source, an electrical circuit, an electro-mechanical drive system, an electric pump, a magnetic drive system, a processor, a mechanical drive system, a pneumatic drive system, a hydraulic drive system, software (e.g., computer-executable instructions stored on a non-transitory computer-storage memory and executed by one or more processors, such as, but not limited to, a local processor, a remote processor, and/or the like, etc.), and/or the like.

The linear actuator 120 disclosed herein may enable the stroke length of the plungers 114*a* and 114*b* to be increased, for example as compared to at least some known reciprocating pump assemblies that utilize one or more crankshafts to reciprocate a plunger within a fluid end section. Moreover, the linear actuator 120 disclosed herein may enable the reciprocating pump assembly to provide a relatively steady flow of fluid (e.g., a relatively uniform flow rate, a relatively constant flow rate, a relatively consistent flow rate, etc.) through the fluid end sections 104*a* and 104*b*. For example, the action of reciprocating the plungers 114 within the plunger bores 116 completes pumping cycles in which fluid is discharged from a first of the fluid end sections (e.g., the fluid end section 104*a* or 104*b*, etc.) while also drawn into a second of the fluid end sections (e.g., the fluid end section 104*a* or 104*b*, etc.) and then discharged out of the second fluid end section while also drawn into the first fluid end section. Such pumping cycles can be continuously (or at least repeatedly) performed to create a relatively steady flow rate of fluid from the reciprocating pump assembly 100 (e.g., for fracking operations, etc.), which for example may reduce flow rate surges of the reciprocating pump assembly 100. In some embodiments, a controller (not shown in FIG. 1; e.g., the controller 200 shown in FIG. 3, etc.) is provided (e.g., as a component of the actuator driver 122, etc.) that operatively connected to the linear actuator 120 such that the controller is configured to electronically control a flow rate of fluid through the fluid end sections 104*a* and 104*b*.

In some embodiments, two or more of the reciprocating pump assemblies 100 can be combined, for example to facilitate providing a steady flow of fluid. For example, and referring now to FIG. 3, multiple reciprocating pump assemblies 100*a-n* are combined together such that linear actuators 120*a-n* thereof control fluid being pumped into and out of fluid end sections 104 thereof, for example in a manner that produces a relatively steady flow rate of fluid. In some embodiments, failure of a linear actuator 120 and/or another component of a reciprocating pump assembly 100 (e.g., the reciprocating pump assembly 100*a*, the reciprocating pump assembly 100*n*, etc.) may be compensated for by one or more of the other reciprocating pump assemblies 100 (e.g., the reciprocating pump assembly 100*a*, the reciprocating pump assembly 100*n*, etc.). While only two reciprocating pump assemblies 100*a* and 100*n* are shown, any number may be used, for example two, three, four, five, six, seven, eight, nine, or ten or more reciprocating pump assemblies 100.

Figure 3:
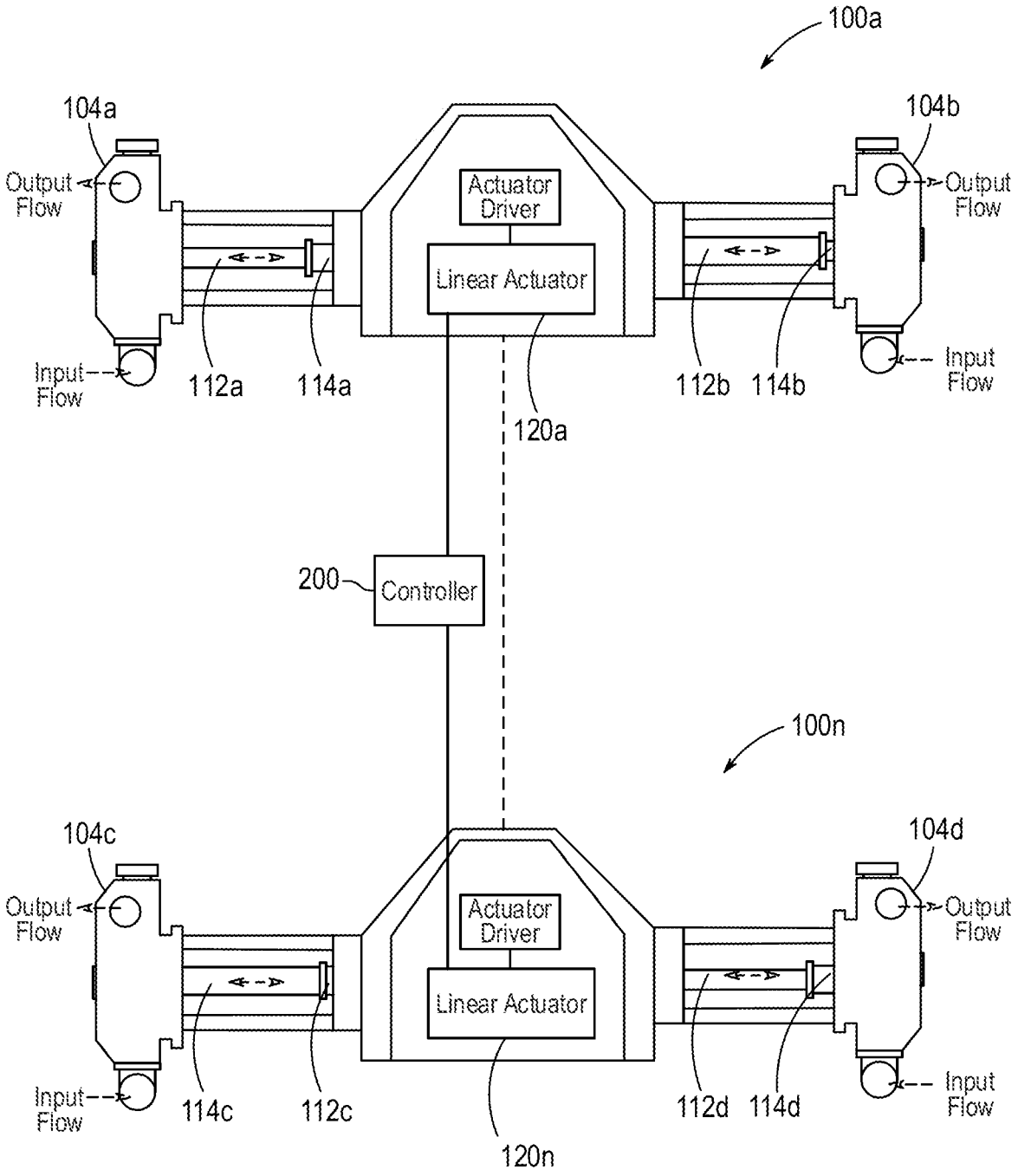
FIG. 3 is an elevational view illustrating a plurality of the reciprocating pump assemblies shown in FIG. 1 combined together according to an exemplary embodiment.

In some embodiments, a controller 200 is operatively connected to the linear actuators 120*a-n* such that the controller 200 is configured to synchronize the various reciprocating pump assemblies 100 to draw and discharge fluid, for example either synchronously and/or at different times that are offset from each other. For example, the controller 200 may be configured to offset the duty cycle of the fluid end sections 104*a* and 104*b* from the duty cycle of the fluid end sections 104*c* and 104*d* shown in FIG. 3. Specifically, and for example, combining multiple reciprocating pump assemblies 100 as is shown in FIG. 3 may enable an operator to offset the linear actuation of plunger rod assemblies 112*a*, 112*b*, 112*c*, and/or 112*d*, and thus the plungers 114*a*, 114*b*, 114*c*, and/or 114*d* in such a way that causes discharging of fluid from each reciprocating pump assembly 100*a* and 100*n* at optimal times, for example to produces a relatively steady flow of fluid (e.g., distributed to well operations, etc.). Examples of timing offsets for multiple reciprocating pump assemblies 100 include, but are not limited to, an offset by one-half of the duty cycle between two or more reciprocating pump assemblies 100, an offset by one-third of the duty cycle between two or more reciprocating pump assemblies 100, an offset by one-quarter of the duty cycle between two or more reciprocating pump assemblies 100, and/or the like.

The controller 200 may be any type of controller, such as, but not limited to, a mechanical controller, an electrical controller, an electro-mechanical controller, a software controller, and/or the like.

Figure 4:
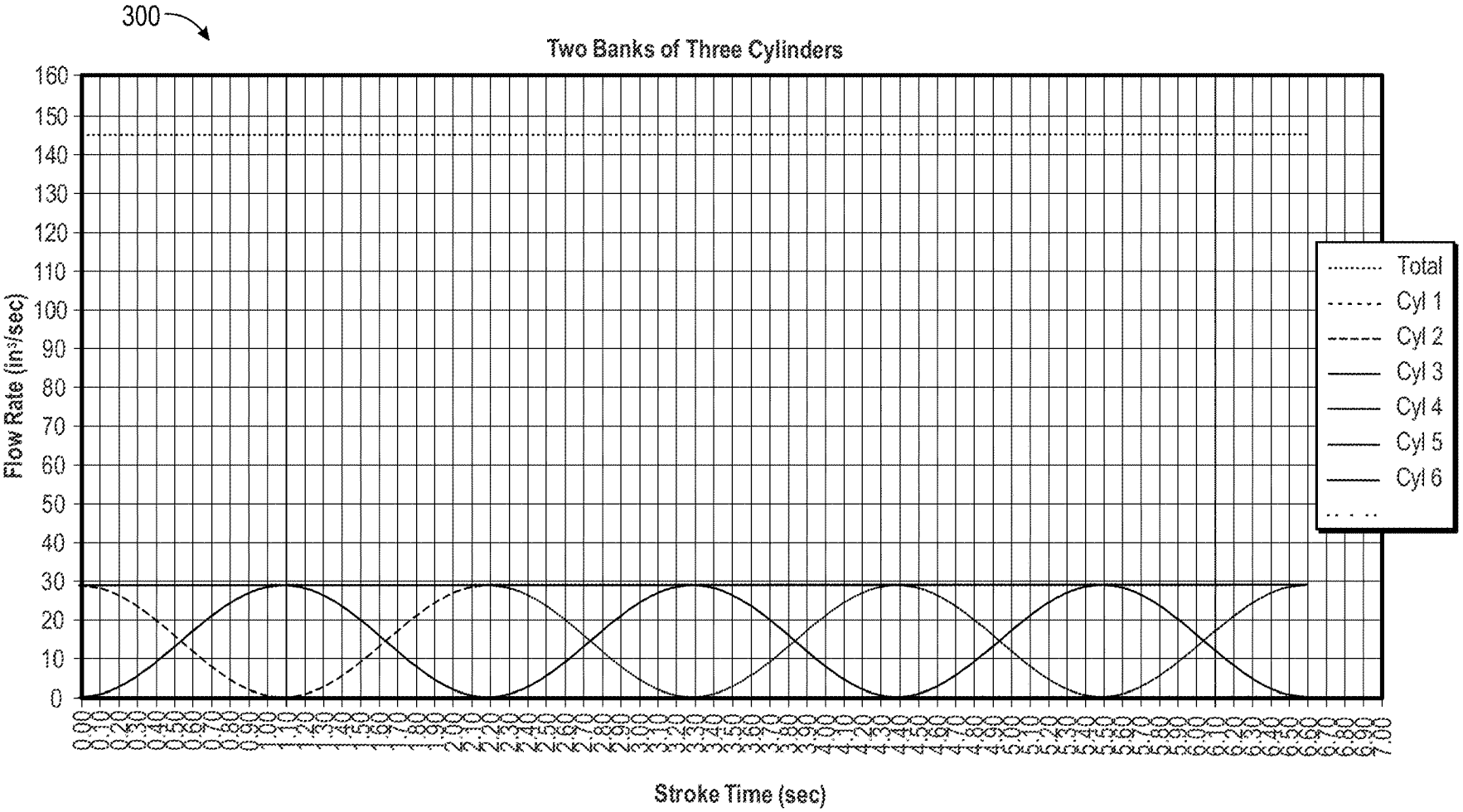
FIG. 4 illustrates a chart showing the combined and individual flow rates of multiple reciprocating pump assemblies according to an exemplary embodiment.

FIG. 4 illustrates a chart 300 showing the combined and individual flow rates of multiple reciprocating pump assemblies 100 with two different banks of three cylinders, according to some embodiments. The following charts illustrate additional pumping details for such a configuration. The embodiment illustrated in FIG. 4 depicts no delay (or offset) between the various reciprocating pump assemblies 100.

Multi Cylinders with Trapezoidal flow rate curves, Haversine ramp

| Cycle | Time | Total | Cyl 1 | Cyl 2 | Cyl 3 | Cyl 4 | Cyl 5 | Cyl 6 |
|---|---|---|---|---|---|---|---|---|
| 0.000 | 0.000 | 144.585 | 0.000 | 28.917 | 28.917 | 28.917 | 28.917 | 28.917 |
| 0.021 | 0.138 | 144.585 | 1.101 | 27.816 | 28.917 | 28.917 | 28.917 | 28.917 |
| 0.042 | 0.275 | 144.585 | 4.235 | 24.682 | 28.917 | 28.917 | 28.917 | 28.917 |
| 0.063 | 0.413 | 144.585 | 8.925 | 19.991 | 28.917 | 28.917 | 28.917 | 28.917 |
| 0.083 | 0.550 | 144.585 | 14.458 | 14.458 | 28.917 | 28.917 | 28.917 | 28.917 |
| 0.104 | 0.688 | 144.585 | 19.991 | 8.925 | 28.917 | 28.917 | 28.917 | 28.917 |
| 0.125 | 0.825 | 144.585 | 24.682 | 4.235 | 28.917 | 28.917 | 28.917 | 28.917 |
| 0.146 | 0.963 | 144.585 | 27.816 | 1.101 | 28.917 | 28.917 | 28.917 | 28.917 |
| 0.167 | 1.100 | 144.585 | 28.917 | 0.000 | 28.917 | 28.917 | 28.917 | 28.917 |
| 0.188 | 1.238 | 144.585 | 28.917 | 1.101 | 27.816 | 28.917 | 28.917 | 28.917 |
| 0.208 | 1.375 | 144.585 | 28.917 | 4.235 | 24.682 | 28.917 | 28.917 | 28.917 |
| 0.229 | 1.513 | 144.585 | 28.917 | 8.925 | 19.991 | 28.917 | 28.917 | 28.917 |
| 0.250 | 1.650 | 144.585 | 28.917 | 14.458 | 14.458 | 28.917 | 28.917 | 28.917 |
| 0.271 | 1.788 | 144.585 | 28.917 | 19.991 | 8.925 | 28.917 | 28.917 | 28.917 |
| 0.292 | 1.925 | 144.585 | 28.917 | 24.682 | 4.235 | 28.917 | 28.917 | 28.917 |
| 0.313 | 2.063 | 144.585 | 28.917 | 27.816 | 1.101 | 28.917 | 28.917 | 28.917 |
| 0.333 | 2.200 | 144.585 | 28.917 | 28.917 | 0.000 | 28.917 | 28.917 | 28.917 |

-continued

| Multi Cylinders with Trapezoidal flow rate curves, Haversine ramp | | | | | | | | |
|---|---|---|---|---|---|---|---|---|
| Cycle | Time | Total | Cyl 1 | Cyl 2 | Cyl 3 | Cyl 4 | Cyl 5 | Cyl 6 |
| 0.354 | 2.338 | 144.585 | 28.917 | 28.917 | 1.101 | 27.816 | 28.917 | 28.917 |
| 0.375 | 2.475 | 144.585 | 28.917 | 28.917 | 4.235 | 24.682 | 28.917 | 28.917 |
| 0.396 | 2.613 | 144.585 | 28.917 | 28.917 | 8.925 | 19.991 | 28.917 | 28.917 |
| 0.417 | 2.750 | 144.585 | 28.917 | 28.917 | 14.458 | 14.458 | 28.917 | 28.917 |
| 0.438 | 2.888 | 144.585 | 28.917 | 28.917 | 19.991 | 8.925 | 28.917 | 28.917 |
| 0.458 | 3.025 | 144.585 | 28.917 | 28.917 | 24.682 | 4.235 | 28.917 | 28.917 |
| 0.479 | 3.163 | 144.585 | 28.917 | 28.917 | 27.816 | 1.101 | 28.917 | 28.917 |
| 0.500 | 3.300 | 144.585 | 28.917 | 28.917 | 28.917 | 0.000 | 28.917 | 28.917 |
| 0.521 | 3.438 | 144.585 | 28.917 | 28.917 | 28.917 | 1.101 | 27.816 | 28.917 |
| 0.542 | 3.575 | 144.585 | 28.917 | 28.917 | 28.917 | 4.235 | 24.682 | 28.917 |
| 0.563 | 3.713 | 144.585 | 28.917 | 28.917 | 28.917 | 8.925 | 19.991 | 28.917 |
| 0.583 | 3.850 | 144.585 | 28.917 | 28.917 | 28.917 | 14.458 | 14.458 | 28.917 |
| 0.604 | 3.988 | 144.585 | 28.917 | 28.917 | 28.917 | 19.991 | 8.925 | 28.917 |
| 0.625 | 4.125 | 144.585 | 28.917 | 28.917 | 28.917 | 24.682 | 4.235 | 28.917 |
| 0.646 | 4.263 | 144.585 | 28.917 | 28.917 | 28.917 | 27.816 | 1.101 | 28.917 |
| 0.667 | 4.400 | 144.585 | 28.917 | 28.917 | 28.917 | 28.917 | 0.000 | 28.917 |
| 0.688 | 4.538 | 144.585 | 28.917 | 28.917 | 28.917 | 28.917 | 1.101 | 27.816 |
| 0.708 | 4.675 | 144.585 | 28.917 | 28.917 | 28.917 | 28.917 | 4.235 | 24.682 |
| 0.729 | 4.813 | 144.585 | 28.917 | 28.917 | 28.917 | 28.917 | 8.925 | 19.991 |
| 0.750 | 4.950 | 144.585 | 28.917 | 28.917 | 28.917 | 28.917 | 14.458 | 14.458 |
| 0.771 | 5.088 | 144.585 | 28.917 | 28.917 | 28.917 | 28.917 | 19.991 | 8.925 |
| 0.792 | 5.225 | 144.585 | 28.917 | 28.917 | 28.917 | 28.917 | 24.682 | 4.235 |
| 0.813 | 5.363 | 144.585 | 28.917 | 28.917 | 28.917 | 28.917 | 27.816 | 1.101 |
| 0.833 | 5.500 | 144.585 | 28.917 | 28.917 | 28.917 | 28.917 | 28.917 | 0.000 |
| 0.854 | 5.638 | 144.585 | 27.816 | 28.917 | 28.917 | 28.917 | 28.917 | 1.101 |
| 0.875 | 5.775 | 144.585 | 24.682 | 28.917 | 28.917 | 28.917 | 28.917 | 4.235 |
| 0.896 | 5.913 | 144.585 | 19.991 | 28.917 | 28.917 | 28.917 | 28.917 | 8.925 |
| 0.917 | 6.050 | 144.585 | 14.458 | 28.917 | 28.917 | 28.917 | 28.917 | 14.458 |
| 0.938 | 6.188 | 144.585 | 8.925 | 28.917 | 28.917 | 28.917 | 28.917 | 19.991 |
| 0.958 | 6.325 | 144.585 | 4.235 | 28.917 | 28.917 | 28.917 | 28.917 | 24.682 |
| 0.979 | 6.463 | 144.585 | 1.101 | 28.917 | 28.917 | 28.917 | 28.917 | 27.816 |
| 1.000 | 6.600 | 144.585 | 0.000 | 28.917 | 28.917 | 28.917 | 28.917 | 28.917 |
| 1.000 | 6.600 | 144.585 | 0.000 | 28.917 | 28.917 | 28.917 | 28.917 | 28.917 |
| 1.000 | 6.600 | 144.585 | 0.000 | 28.917 | 28.917 | 28.917 | 28.917 | 28.917 |
| 1.000 | 6.600 | 144.585 | 0.000 | 28.917 | 28.917 | 28.917 | 28.917 | 28.917 |
| 1.000 | 6.600 | 144.585 | 0.000 | 28.917 | 28.917 | 28.917 | 28.917 | 28.917 |
| 1.000 | 6.600 | 144.585 | 0.000 | 28.917 | 28.917 | 28.917 | 28.917 | 28.917 |
| 1.000 | 6.600 | 144.585 | 0.000 | 28.917 | 28.917 | 28.917 | 28.917 | 28.917 |
| 1.000 | 6.600 | 144.585 | 0.000 | 28.917 | 28.917 | 28.917 | 28.917 | 28.917 |
| 1.000 | 6.600 | 144.585 | 0.000 | 28.917 | 28.917 | 28.917 | 28.917 | 28.917 |

| Hydraulic Horsepower Table 10 in stroke 4.5 in plunger 12 kpsi pressure | | | | | | | | | |
|---|---|---|---|---|---|---|---|---|---|
| | | Cylinders that determine Profile | | | | | | | |
| | 263 | 2 | 3 | 4 | 5 | 6 | 7 | 8 | 9 |
| Sync he | 1 | 263 | 263 | 263 | 263 | 263 | 263 | 263 | 263 |
| | 2 | 526 | 526 | 526 | 526 | 526 | 526 | 526 | 526 |
| | 3 | 789 | 789 | 789 | 789 | 789 | 789 | 789 | 789 |
| | 4 | 1052 | 1052 | 1052 | 1052 | 1052 | 1052 | 1052 | 1052 |
| | 5 | 1314 | 1314 | 1314 | 1314 | 1314 | 1314 | 1314 | 1314 |
| | 6 | 1577 | 1577 | 1577 | 1577 | 1577 | 1577 | 1577 | 1577 |
| | 7 | 1840 | 1840 | 1840 | 1840 | 1840 | 1840 | 1840 | 1840 |
| | 8 | 2103 | 2103 | 2103 | 2103 | 2103 | 2103 | 2103 | 2103 |
| | 9 | 2366 | 2366 | 2366 | 2366 | 2366 | 2366 | 2366 | 2366 |

| | | |
|---|---|---|
| Number of Cylinders C | 6 | 0.833333 |
| Multiple of synched Cylinders | 1 | |
| Stroke | 10 | in |
| Ramp Time $t_r$ | 1.1 | sec |
| Plunger Diameter | 4.5 | in |
| Intensifier Ratio | 3 | :1 |
| Job Pressure | 12000 | psi |
| Dwell Time $t_d$ | 4.4 | |
| Maximum Pressure | 15000 | psi |
| T | 6.6 | sec |
| Cylinder Rod Length | 42 | in |

-continued

| | | |
|---|---|---|
| Cylinder Rod Modulus | 2.90E+07 | psi |
| Min Cylinder Rod diameter | 4.00 | in |
| Actual Cylinder Rod diameter | 4.50 | in |
| Cylinder Piston Diameter | 9.00 | in |
| Job Cylinder Pressure | 4000 | psi |
| Stroke Volume per stroke per cylinder | 159 | $in^3$ |
| Volume rate per cylinder | 28.91693 | $in^3$/sec |
| Volume rate all cylinders | 144.5847 | $in^3$/sec |
| A for Plunger | 28.91693 | $in^3$/sec |
| A for Hydraulic Piston | 86.7508 | $in^3$/sec |
| Rod Load | 190851.8 | lbf |
| Max Rod Load | 238564.7 | lbf |

Figure 5:
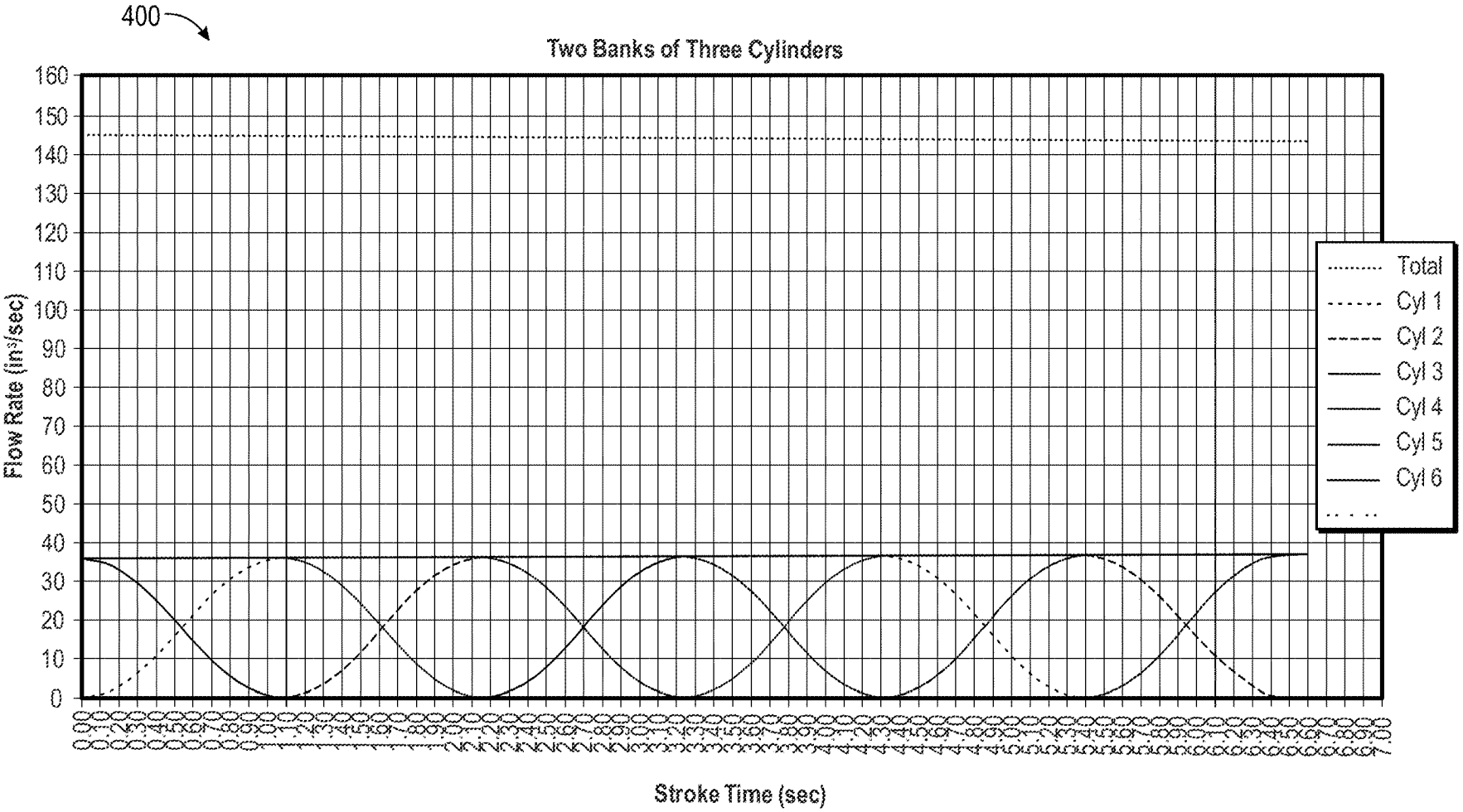
FIG. 5 illustrates a chart showing the combined and individual flow rates of multiple reciprocating pump assemblies according to an exemplary embodiment.

FIG. 5 illustrates a chart 400 showing the combined and individual flow rates of multiple reciprocating pump assemblies 100 with two different banks of three cylinders, according to some embodiments. The following charts illustrate additional pumping details for such a configuration. The embodiment of FIG. 5 depicts a ramp-up delay (or offset) between the various reciprocating pump assemblies 100.

Multi Cylinders with Trapezoidal flow rate curves, Haversine ramp

| Cycle | Time | Total | Cyl 1 | Cyl 2 | Cyl 3 | Cyl 4 | Cyl 5 | Cyl 6 |
|---|---|---|---|---|---|---|---|---|
| 0.000 | 0.000 | 144.585 | 0.000 | 0.000 | 36.146 | 36.146 | 36.146 | 36.146 |
| 0.021 | 0.138 | 144.585 | 1.376 | 0.000 | 34.770 | 36.146 | 36.146 | 36.146 |
| 0.042 | 0.275 | 144.585 | 5.293 | 0.000 | 30.853 | 36.146 | 36.146 | 36.146 |
| 0.063 | 0.413 | 144.585 | 11.157 | 0.000 | 24.989 | 36.146 | 36.146 | 36.146 |
| 0.083 | 0.550 | 144.585 | 18.073 | 0.000 | 18.073 | 36.146 | 36.146 | 36.146 |
| 0.104 | 0.688 | 144.585 | 24.989 | 0.000 | 11.157 | 36.146 | 36.146 | 36.146 |
| 0.125 | 0.825 | 144.585 | 30.853 | 0.000 | 5.293 | 36.146 | 36.146 | 36.146 |
| 0.146 | 0.963 | 144.585 | 34.770 | 0.000 | 1.376 | 36.146 | 36.146 | 36.146 |
| 0.167 | 1.100 | 144.585 | 36.146 | 0.000 | 0.000 | 36.146 | 36.146 | 36.146 |
| 0.188 | 1.238 | 144.585 | 36.146 | 1.376 | 0.000 | 34.770 | 36.146 | 36.146 |
| 0.208 | 1.375 | 144.585 | 36.146 | 5.293 | 0.000 | 30.853 | 36.146 | 36.146 |
| 0.229 | 1.513 | 144.585 | 36.146 | 11.157 | 0.000 | 24.989 | 36.146 | 36.146 |
| 0.250 | 1.650 | 144.585 | 36.146 | 18.073 | 0.000 | 18.073 | 36.146 | 36.146 |
| 0.271 | 1.788 | 144.585 | 36.146 | 24.989 | 0.000 | 11.157 | 36.146 | 36.146 |
| 0.292 | 1.925 | 144.585 | 36.146 | 30.853 | 0.000 | 5.293 | 36.146 | 36.146 |
| 0.313 | 2.063 | 144.585 | 36.146 | 34.770 | 0.000 | 1.376 | 36.146 | 36.146 |
| 0.333 | 2.200 | 144.585 | 36.146 | 36.146 | 0.000 | 0.000 | 36.146 | 36.146 |
| 0.354 | 2.338 | 144.585 | 36.146 | 36.146 | 1.376 | 0.000 | 34.770 | 36.146 |
| 0.375 | 2.475 | 144.585 | 36.146 | 36.146 | 5.293 | 0.000 | 30.853 | 36.146 |
| 0.396 | 2.613 | 144.585 | 36.146 | 36.146 | 11.157 | 0.000 | 24.989 | 36.146 |
| 0.417 | 2.750 | 144.585 | 36.146 | 36.146 | 18.073 | 0.000 | 18.073 | 36.146 |
| 0.438 | 2.888 | 144.585 | 36.146 | 36.146 | 24.989 | 0.000 | 11.157 | 36.146 |
| 0.458 | 3.025 | 144.585 | 36.146 | 36.146 | 30.853 | 0.000 | 5.293 | 36.146 |
| 0.479 | 3.163 | 144.585 | 36.146 | 36.146 | 34.770 | 0.000 | 1.376 | 36.146 |
| 0.500 | 3.300 | 144.585 | 36.146 | 36.146 | 36.146 | 0.000 | 0.000 | 36.146 |
| 0.521 | 3.438 | 144.585 | 36.146 | 36.146 | 36.146 | 1.376 | 0.000 | 34.770 |
| 0.542 | 3.575 | 144.585 | 36.146 | 36.146 | 36.146 | 5.293 | 0.000 | 30.853 |
| 0.563 | 3.713 | 144.585 | 36.146 | 36.146 | 36.146 | 11.157 | 0.000 | 24.989 |
| 0.583 | 3.850 | 144.585 | 36.146 | 36.146 | 36.146 | 18.073 | 0.000 | 18.073 |
| 0.604 | 3.988 | 144.585 | 36.146 | 36.146 | 36.146 | 24.989 | 0.000 | 11.157 |
| 0.625 | 4.125 | 144.585 | 36.146 | 36.146 | 36.146 | 30.853 | 0.000 | 5.293 |
| 0.646 | 4.263 | 144.585 | 36.146 | 36.146 | 36.146 | 34.770 | 0.000 | 1.376 |
| 0.667 | 4.400 | 144.585 | 36.146 | 36.146 | 36.146 | 36.146 | 0.000 | 0.000 |
| 0.688 | 4.538 | 144.585 | 34.770 | 36.146 | 36.146 | 36.146 | 1.376 | 0.000 |
| 0.708 | 4.675 | 144.585 | 30.853 | 36.146 | 36.146 | 36.146 | 5.293 | 0.000 |
| 0.729 | 4.813 | 144.585 | 24.989 | 36.146 | 36.146 | 36.146 | 11.157 | 0.000 |
| 0.750 | 4.950 | 144.585 | 18.073 | 36.146 | 36.146 | 36.146 | 18.073 | 0.000 |
| 0.771 | 5.088 | 144.585 | 11.157 | 36.146 | 36.146 | 36.146 | 24.989 | 0.000 |
| 0.792 | 5.225 | 144.585 | 5.293 | 36.146 | 36.146 | 36.146 | 30.853 | 0.000 |
| 0.813 | 5.363 | 144.585 | 1.376 | 36.146 | 36.146 | 36.146 | 34.770 | 0.000 |
| 0.833 | 5.500 | 144.585 | 0.000 | 36.146 | 36.146 | 36.146 | 36.146 | 0.000 |
| 0.854 | 5.638 | 144.585 | 0.000 | 34.770 | 36.146 | 36.146 | 36.146 | 1.376 |
| 0.875 | 5.775 | 144.585 | 0.000 | 30.853 | 36.146 | 36.146 | 36.146 | 5.293 |
| 0.896 | 5.913 | 144.585 | 0.000 | 24.989 | 36.146 | 36.146 | 36.146 | 11.157 |
| 0.917 | 6.050 | 144.585 | 0.000 | 18.073 | 36.146 | 36.146 | 36.146 | 18.073 |
| 0.938 | 6.188 | 144.585 | 0.000 | 11.157 | 36.146 | 36.146 | 36.146 | 24.989 |
| 0.958 | 6.325 | 144.585 | 0.000 | 5.293 | 36.146 | 36.146 | 36.146 | 30.853 |
| 0.979 | 6.463 | 144.585 | 0.000 | 1.376 | 36.146 | 36.146 | 36.146 | 34.770 |
| 1.000 | 6.600 | 144.585 | 0.000 | 0.000 | 36.146 | 36.146 | 36.146 | 36.146 |
| 1.000 | 6.600 | 144.585 | 0.000 | 0.000 | 36.146 | 36.146 | 36.146 | 36.146 |
| 1.000 | 6.600 | 144.585 | 0.000 | 0.000 | 36.146 | 36.146 | 36.146 | 36.146 |
| 1.000 | 6.600 | 144.585 | 0.000 | 0.000 | 36.146 | 36.146 | 36.146 | 36.146 |
| 1.000 | 6.600 | 144.585 | 0.000 | 0.000 | 36.146 | 36.146 | 36.146 | 36.146 |
| 1.000 | 6.600 | 144.585 | 0.000 | 0.000 | 36.146 | 36.146 | 36.146 | 36.146 |
| 1.000 | 6.600 | 144.585 | 0.000 | 0.000 | 36.146 | 36.146 | 36.146 | 36.146 |
| 1.000 | 6.600 | 144.585 | 0.000 | 0.000 | 36.146 | 36.146 | 36.146 | 36.146 |
| 1.000 | 6.600 | 144.585 | 0.000 | 0.000 | 36.146 | 36.146 | 36.146 | 36.146 |

| | | | |
|---|---|---|---|
| Number of Cylinders C | 6 | 0.833333 | |
| Multiple of synched Cylinders | 1 | | |
| Stroke | 10 | in | 2.272727 |
| Ramp Time $t_r$ | 1.1 | sec | Matzner |
| Plunger Diameter | 4.5 | in | |
| Intensifier Ratio | 3 | :1 | |
| Job Pressure | 12000 | psi | |
| Dwell Time $t_d$ | 3.3 | | |
| Maximum Pressure | 15000 | psi | |
| T | 6.6 | sec | |
| Cylinder Rod Length | 42 | in | |
| Cylinder Rod Modulus | 2.90E+07 | psi | Alternate |
| Min Cylinder Rod diameter | 4.00 | in | |

-continued

| | | | |
|---|---|---|---|
| Actual Cylinder Rod diameter | 4.50 | in | |
| Cylinder Piston Diameter | 9.00 | in | |
| Job Cylinder Pressure | 4000 | psi | |
| Stroke Volume per stroke per cylinder | 159 | $in^3$ | 0.69 |
| Volume rate per cylinder | 36.14617 | $in^3$/sec | 9.388614 |
| Volume rate all cylinders | 144.5847 | $in^3$/sec | 37.55446 |
| A for Plunger | 36.14617 | $in^3$/sec | 1.818182 |
| A for Hydraulic Piston | 108.4385 | $in^3$/sec | 2.272727 |
| Rod Load | 190851.8 | lbf | |
| Max Rod Load | 238564.7 | lbf | |

Figure 6:
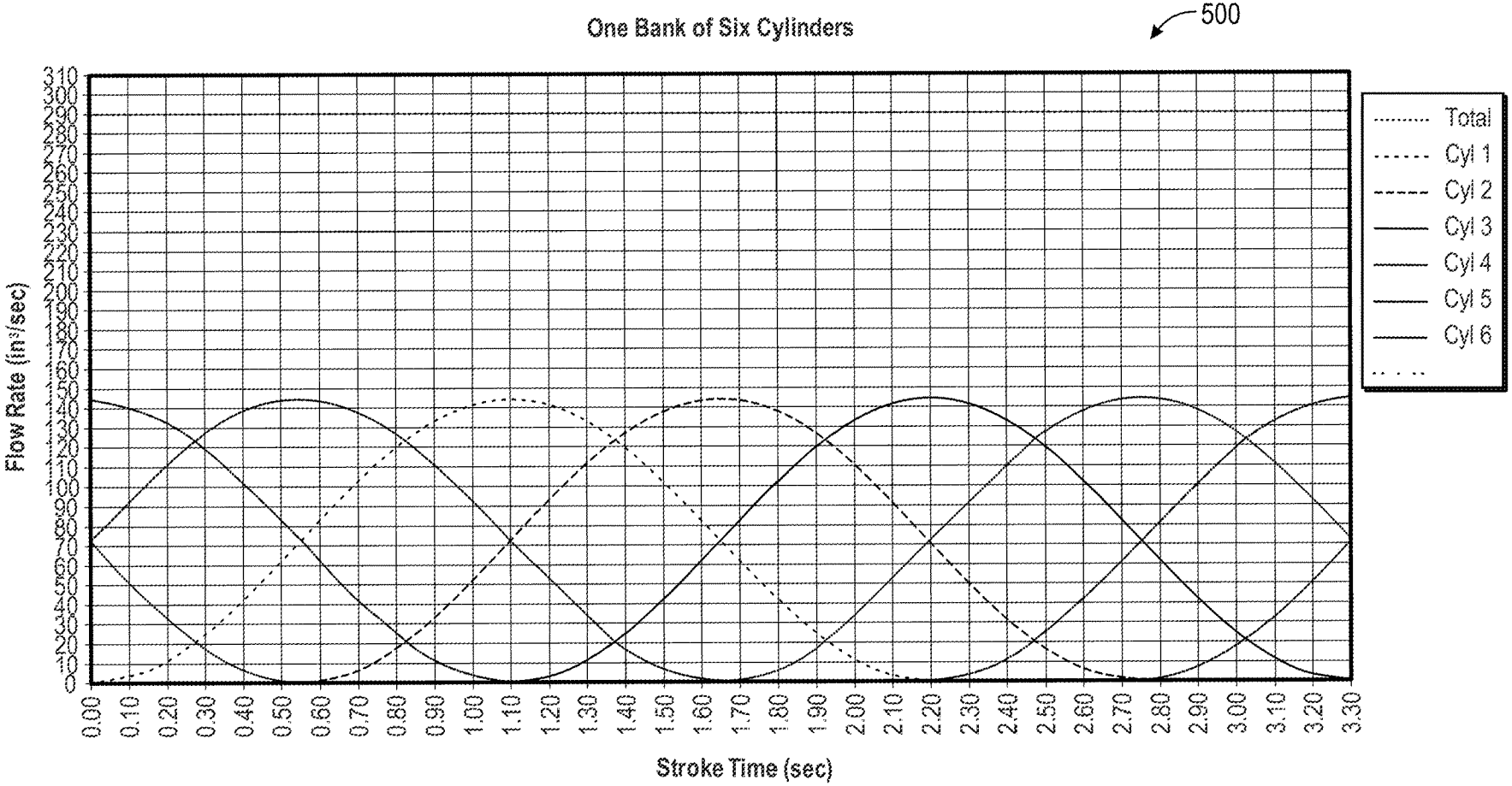
FIG. 6 illustrates a chart showing the combined and individual flow rates of multiple reciprocating pump assemblies according to an exemplary embodiment.

FIG. 6 illustrates a chart 500 showing the combined and individual flow rates of multiple reciprocating pump assemblies 100 with two different banks of three cylinders, according to some embodiments. The following charts illustrate additional pumping details for such a configuration. The embodiment of FIG. 6 depicts a half overlap between different sets of the reciprocating pump assemblies 100.

| | | |
|---|---|---|
| Number of Cylinders C | 3 | 0.666667 |
| Multiple of synched Cylinders | 1 | |
| Stroke | 10 | in |
| Ramp Time $t_r$ | 1.1 | sec |
| Plunger Diameter | 4.5 | in |
| Intensifier Ratio | 3 | :1 |

Multi Cylinders with Trapezoidal flow rate curves, Haversine ramp

| Cycle | Time | Total | Cyl 1 | Cyl 2 | Cyl 3 | Cyl 4 | Cyl 5 | Cyl 6 |
|---|---|---|---|---|---|---|---|---|
| 0.000 | 0.000 | 289.169 | 0.000 | 0.000 | 0.000 | 72.292 | 144.585 | 72.292 |
| 0.042 | 0.138 | 289.169 | 5.503 | 0.000 | 0.000 | 44.627 | 139.082 | 99.957 |
| 0.083 | 0.275 | 289.169 | 21.174 | 0.000 | 0.000 | 21.174 | 123.411 | 123.411 |
| 0.125 | 0.413 | 289.169 | 44.627 | 0.000 | 0.000 | 5.503 | 99.957 | 139.082 |
| 0.167 | 0.550 | 289.169 | 72.292 | 0.000 | 0.000 | 0.000 | 72.292 | 144.585 |
| 0.208 | 0.688 | 289.169 | 99.957 | 5.503 | 0.000 | 0.000 | 44.627 | 139.082 |
| 0.250 | 0.825 | 289.169 | 123.411 | 21.174 | 0.000 | 0.000 | 21.174 | 123.411 |
| 0.292 | 0.963 | 289.169 | 139.082 | 44.627 | 0.000 | 0.000 | 5.503 | 99.957 |
| 0.333 | 1.100 | 289.169 | 144.585 | 72.292 | 0.000 | 0.000 | 0.000 | 72.292 |
| 0.375 | 1.238 | 289.169 | 139.082 | 99.957 | 5.503 | 0.000 | 0.000 | 44.627 |
| 0.417 | 1.375 | 289.169 | 123.411 | 123.411 | 21.174 | 0.000 | 0.000 | 21.174 |
| 0.458 | 1.513 | 289.169 | 99.957 | 139.082 | 44.627 | 0.000 | 0.000 | 5.503 |
| 0.500 | 1.650 | 289.169 | 72.292 | 144.585 | 72.292 | 0.000 | 0.000 | 0.000 |
| 0.542 | 1.788 | 289.169 | 44.627 | 139.082 | 99.957 | 5.503 | 0.000 | 0.000 |
| 0.583 | 1.925 | 289.169 | 21.174 | 123.411 | 123.411 | 21.174 | 0.000 | 0.000 |
| 0.625 | 2.063 | 289.169 | 5.503 | 99.957 | 139.082 | 44.627 | 0.000 | 0.000 |
| 0.667 | 2.200 | 289.169 | 0.000 | 72.292 | 144.585 | 72.292 | 0.000 | 0.000 |
| 0.708 | 2.338 | 289.169 | 0.000 | 44.627 | 139.082 | 99.957 | 5.503 | 0.000 |
| 0.750 | 2.475 | 289.169 | 0.000 | 21.174 | 123.411 | 123.411 | 21.174 | 0.000 |
| 0.792 | 2.613 | 289.169 | 0.000 | 5.503 | 99.957 | 139.082 | 44.627 | 0.000 |
| 0.833 | 2.750 | 289.169 | 0.000 | 0.000 | 72.292 | 144.585 | 72.292 | 0.000 |
| 0.875 | 2.888 | 289.169 | 0.000 | 0.000 | 44.627 | 139.082 | 99.957 | 5.503 |
| 0.917 | 3.025 | 289.169 | 0.000 | 0.000 | 21.174 | 123.411 | 123.411 | 21.174 |
| 0.958 | 3.163 | 289.169 | 0.000 | 0.000 | 5.503 | 99.957 | 139.082 | 44.627 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |
| 1.000 | 3.300 | 289.169 | 0.000 | 0.000 | 0.000 | 72.292 | 144.585 | 72.292 |

Figure 7:
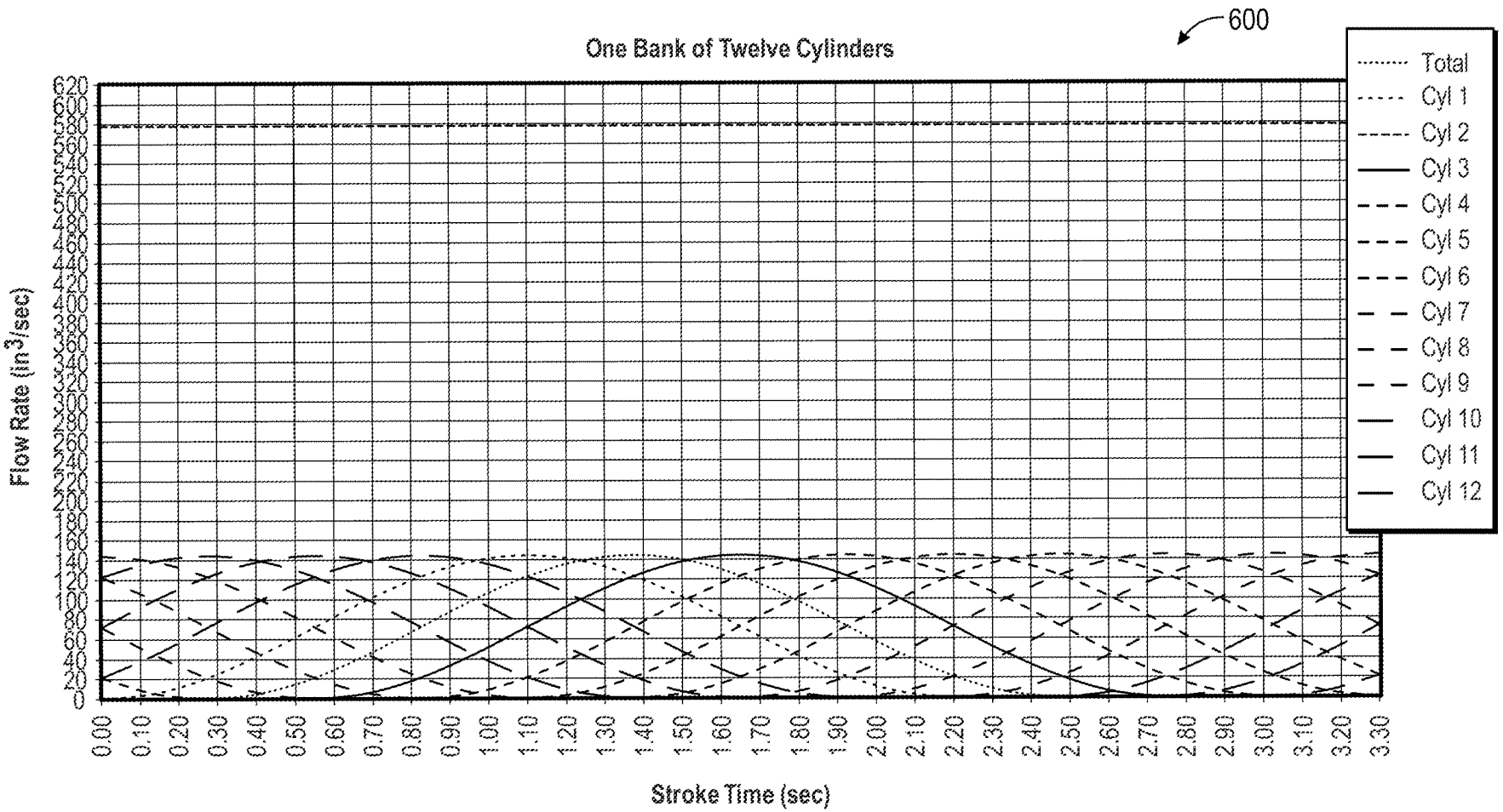
FIG. 7 illustrates a chart showing the combined and individual flow rates of multiple reciprocating pump assemblies according to an exemplary embodiment.

FIG. 7 illustrates a chart 600 showing the combined and individual flow rates of multiple reciprocating pump assemblies 100 with two different banks of three cylinders, according to some embodiments. The following chart illustrates additional pumping details for such a configuration. The embodiment of FIG. 7 depicts a quarter overlap between different sets of the reciprocating pump assemblies 100.

-continued

| | | |
|---|---|---|
| Job Pressure | 12000 | psi |
| Dwell Time $t_d$ | 0 | |
| Maximum Pressure | 15000 | psi |
| T | 3.3 | sec |
| Cylinder Rod Length | 42 | in |

-continued

| | | |
|---|---|---|
| Cylinder Rod Modulus | 2.90E+07 | psi |
| Min Cylinder Rod diameter | 4.00 | in |
| Actual Cylinder Rod diameter | 4.50 | in |
| Cylinder Piston Diameter | 9.00 | in |
| Job Cylinder Pressure | 4000 | psi |
| Stroke Volume per stroke per cylinder | 159 | $in^3$ |
| Volume rate per cylinder | 144.5847 | $in^3$/sec |
| Volume rate all cylinders | 144.5847 | $in^3$/sec |
| A for Plunger | 144.5847 | $in^3$/sec |
| A for Hydraulic Piston | 433.754 | $in^3$/sec |
| Rod Load | 190851.8 | lbf |
| Max Rod Load | 238564.7 | lbf |

Figure 8:
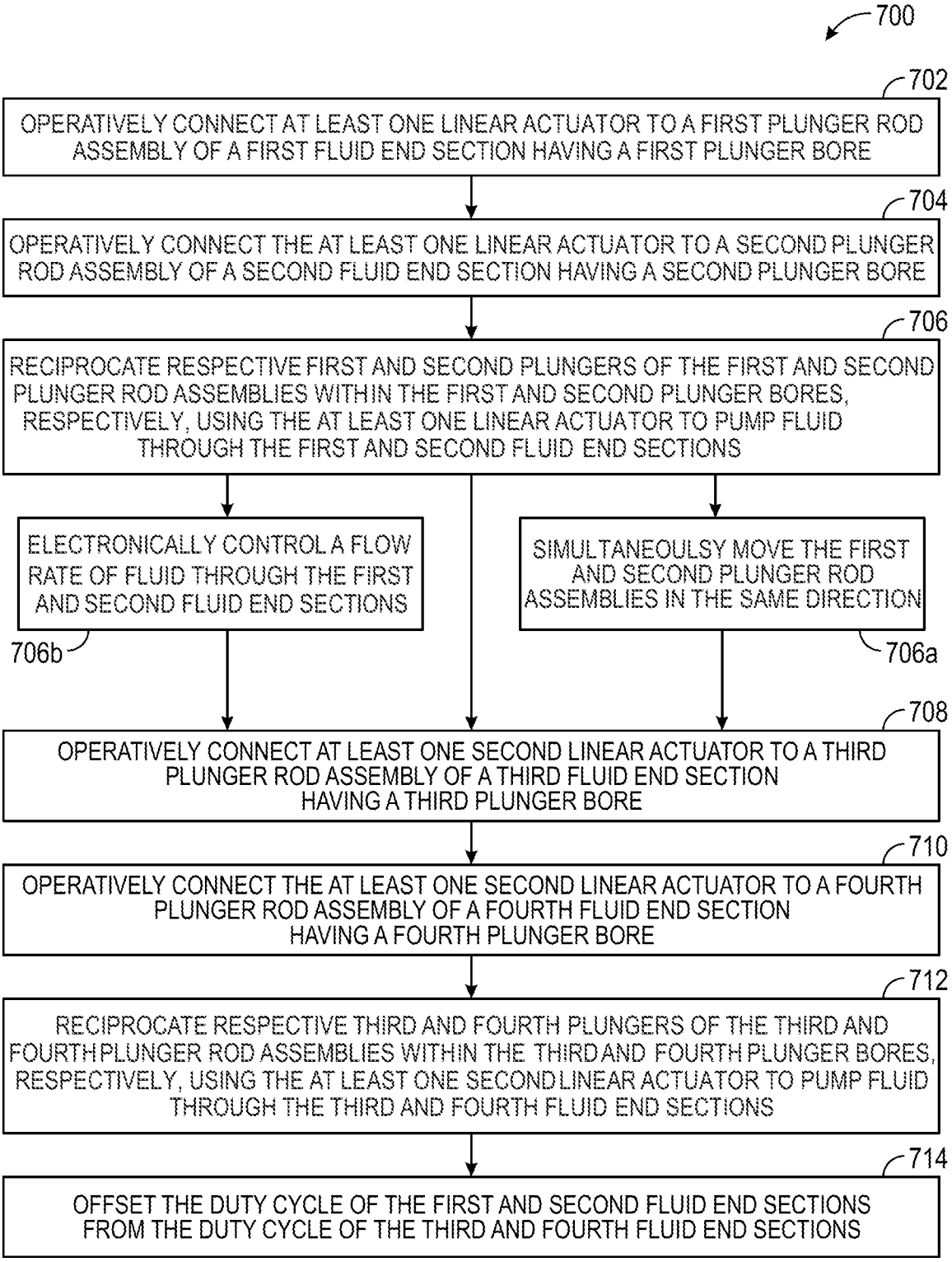
FIG. 8 is a flowchart illustrating a method for operating a reciprocating pump assembly according to an exemplary embodiment.

FIG. 8 is a flowchart illustrating a method 700 for operating a reciprocating pump assembly according to an exemplary embodiment. The method 700 includes operatively connecting, at 702, at least one linear actuator to a first plunger rod assembly of a first fluid end section having a first plunger bore. At 704, the method 700 includes operatively connecting the at least one linear actuator to a second plunger rod assembly of a second fluid end section having a second plunger bore. At 706, the method 700 includes reciprocating respective first and second plungers of the first and second plunger rod assemblies within the first and second plunger bores, respectively, using the at least one linear actuator to pump fluid through the first and second fluid end sections.

In some embodiments, reciprocating at 706 the first and second plungers within the first and second plunger bores, respectively, using the at least one linear actuator includes simultaneously moving, at 706*a*, the first and second plunger rod assemblies in the same direction. Reciprocating at 706 the first and second plungers within the first and second plunger bores, respectively, using the at least one linear actuator includes electronically controlling, at 706*b*, a flow rate of fluid through the first and second fluid end sections in some embodiments.

Optionally, the at least one linear actuator is at least one first linear actuator and the method 700 further includes: operatively connecting, at 708, at least one second linear actuator to a third plunger rod assembly of a third fluid end section having a third plunger bore; operatively connecting, at 710, the at least one second linear actuator to a fourth plunger rod assembly of a fourth fluid end section having a fourth plunger bore; reciprocating, at 712, respective third and fourth plungers of the third and fourth plunger rod assemblies within the third and fourth plunger bores, respectively, using the at least one second linear actuator to pump fluid through the third and fourth fluid end sections; and offsetting, at 714, the duty cycle of the first and second fluid end sections from the duty cycle of the third and fourth fluid end sections.

Various embodiments disclosed herein increase the stroke length of the plunger of the fluid end section of a reciprocating pump assembly and thereby reduce the number of sealing events experienced by valve assemblies of the fluid end section during operation of the reciprocating pump assembly. Various embodiments disclosed herein increase the longevity of the valve assemblies of a fluid end section of a reciprocating pump assembly and thereby reduce the operating costs of a reciprocating pump assembly. Various embodiments disclosed herein provide a relatively steady flow of fluid (e.g., a relatively uniform flow rate, a relatively constant flow rate, a relatively consistent flow rate, etc.) through a fluid end section of a reciprocating pump assembly. Various embodiments disclosed herein may reduce flow rate surges of a reciprocating pump assembly.

The following clauses describe further aspects of the disclosure:

Clause Set A:

A1. A reciprocating pump assembly comprising:

a fluid end section having a pressure chamber and a plunger bore that fluidly communicates with the pressure chamber;

a plunger configured to be held within the plunger bore of the fluid end section; and a linear actuator operatively connected to the plunger such that the linear actuator is configured to reciprocate the plunger within the plunger bore during operation of the reciprocating pump to thereby pump fluid through the fluid end section.

A2. The reciprocating pump assembly of clause A1, wherein the linear actuator comprises at least one of a mechanical linear actuator, an electrical linear actuator, an electro-mechanical linear actuator, a magnetic linear actuator, a hydraulic linear actuator, a pneumatic linear actuator, a screw-type actuator, a ball screw, a lead screw, a rotary screw, a screw jack, a roller screw, a hydraulic piston, a linear motor, a wheel and axle actuator, a telescoping linear actuator, a solenoid, or a servo.

A3. The reciprocating pump assembly of clause A1, further comprising a driver configured to drive operation of the linear actuator, the driver comprising at least one of an engine, an electrical motor, a turbine, a hydraulic pump, a pneumatic pump, a mechanical pump, an electrical power source, an electrical circuit, a processor, a mechanical drive system, a pneumatic system, or a hydraulic system.

A4. The reciprocating pump assembly of clause A1, further comprising a power end section that comprises the linear actuator.

A5. The reciprocating pump assembly of clause A1, further comprising a controller operatively connected to the linear actuator such that the controller is configured to electronically control a flow rate of fluid through the fluid end section.

Clause Set B:

B1. A reciprocating pump assembly comprising:

a first fluid end section having a first pressure chamber and a first plunger bore that fluidly communicates with the first pressure chamber;

a first plunger rod assembly comprising a first plunger configured to be held within the first plunger bore of the first fluid end section;

a second fluid end section having a second pressure chamber and a second plunger bore that fluidly communicates with the second pressure chamber;

a second plunger rod assembly comprising a second plunger configured to be held within the second plunger bore of the second fluid end section; and at least one linear actuator operatively connected to the first and second plunger rod assemblies such that the at least one linear actuator is configured to reciprocate the first and second plungers within the first and second plunger bores, respectively, during operation of the reciprocating pump to thereby pump fluid through the first and second fluid end sections.

B2. The reciprocating pump assembly of clause B1, wherein the at least one linear actuator comprises at least one of a mechanical linear actuator, an electrical linear actuator, an electro-mechanical linear actuator, a magnetic linear actuator, a hydraulic linear actuator, a pneumatic linear actuator, a screw-type actuator, a ball screw, a lead screw, a rotary screw, a screw jack, a roller screw, a hydraulic piston, a linear motor, a wheel and axle actuator, a telescoping linear actuator, a solenoid, or a servo.

B3. The reciprocating pump assembly of clause B1, further comprising at least one driver configured to drive operation of the at least one linear actuator, the driver comprising at least one of an engine, an electrical motor, a turbine, a hydraulic pump, a pneumatic pump, a mechanical pump, an electrical power source, an electrical circuit, a processor, a mechanical drive system, a pneumatic system, or a hydraulic system.

B4. The reciprocating pump assembly of clause B1, further comprising a power end section that comprises the at least one linear actuator.

B5. The reciprocating pump assembly of clause B1, wherein at least one of the first fluid end section includes only a single one of the first pressure chamber or the second fluid end section includes only a single one of the second pressure chamber.

B6. The reciprocating pump assembly of clause B1, wherein the first and second plunger rod assemblies are operatively connected to the at least one linear actuator such that the first and second plunger rod assemblies are coaxially aligned with each other.

B7. The reciprocating pump assembly of clause B1, wherein the at least one linear actuator is configured to simultaneously move the first and second plunger rod assemblies in the same direction.

B8. The reciprocating pump assembly of clause B1, wherein the at least one linear actuator is configured to simultaneously move the first and second plunger rod assemblies in opposite directions.

B9. The reciprocating pump assembly of clause B1, wherein the at least one linear actuator is at least one first linear actuator, the reciprocating pump assembly further comprising:

a third fluid end section having a third pressure chamber and a third plunger bore that fluidly communicates with the third pressure chamber;

a third plunger rod assembly comprising a third plunger configured to be held within the third plunger bore of the third fluid end section;

a fourth fluid end section having a fourth pressure chamber and a fourth plunger bore that fluidly communicates with the fourth pressure chamber;

a fourth plunger rod assembly comprising a fourth plunger configured to be held within the fourth plunger bore of the fourth fluid end section; and at least one second linear actuator operatively connected to the third and fourth plunger rod assemblies such that the at least one second linear actuator is configured to reciprocate the third and fourth plungers within the third and fourth plunger bores, respectively, during operation of the reciprocating pump to thereby pump fluid through the third and fourth fluid end sections.

B10. The reciprocating pump assembly of clause B1, further comprising a controller operatively connected to the at least one linear actuator such that the controller is configured to electronically control a flow rate of fluid through the first and second fluid end sections.

B11. The reciprocating pump assembly of clause B1, wherein the at least one linear actuator is at least one first linear actuator, the reciprocating pump assembly further comprising:

a third fluid end section having a third pressure chamber and a third plunger bore that fluidly communicates with the third pressure chamber;

a third plunger rod assembly comprising a third plunger configured to be held within the third plunger bore of the third fluid end section;

a fourth fluid end section having a fourth pressure chamber and a fourth plunger bore that fluidly communicates with the fourth pressure chamber;

a fourth plunger rod assembly comprising a fourth plunger configured to be held within the fourth plunger bore of the fourth fluid end section;

at least one second linear actuator operatively connected to the third and fourth plunger rod assemblies such that the at least one second linear actuator is configured to reciprocate the third and fourth plungers within the third and fourth plunger bores, respectively, during operation of the reciprocating pump to thereby pump fluid through the third and fourth fluid end sections; and a controller operatively connected to the at least one first linear actuator and the at least one second linear actuator such that the controller is configured to offset the duty cycle of the first and second fluid end sections from the duty cycle of the third and fourth fluid end sections.

Clause Set C:

C1. A method for operating a reciprocating pump assembly comprising:

operatively connecting at least one linear actuator to a first plunger rod assembly of a first fluid end section having a first plunger bore;

operatively connecting the at least one linear actuator to a second plunger rod assembly of a second fluid end section having a second plunger bore; and reciprocating respective first and second plungers of the first and second plunger rod assemblies within the first and second plunger bores, respectively, using the at least one linear actuator to pump fluid through the first and second fluid end sections.

C2. The method of clause C1, wherein reciprocating the first and second plungers within the first and second plunger bores, respectively, using the at least one linear actuator comprises simultaneously moving the first and second plunger rod assemblies in the same direction.

C3. The method of clause C1, wherein reciprocating the first and second plungers within the first and second plunger bores, respectively, using the at least one linear actuator comprises electronically controlling a flow rate of fluid through the first and second fluid end sections.

C4. The method of clause C1, wherein the at least one linear actuator is at least one first linear actuator, the method further comprising:

operatively connecting at least one second linear actuator to a third plunger rod assembly of a third fluid end section having a third plunger bore;

operatively connecting the at least one second linear actuator to a fourth plunger rod assembly of a fourth fluid end section having a fourth plunger bore;

reciprocating respective third and fourth plungers of the third and fourth plunger rod assemblies within the third and fourth plunger bores, respectively, using the at least one second linear actuator to pump fluid through the third and fourth fluid end sections; and offsetting the duty cycle of the first and second fluid end sections from the duty cycle of the third and fourth fluid end sections.

It is to be understood that the above description is intended to be illustrative, and not restrictive. For example, the above-described embodiments (and/or aspects thereof) may be used in combination with each other. Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Further, each independent feature or component of any given assembly may constitute an additional embodiment. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as 'clockwise_ and 'counterclockwise_, 'left_ and right_, 'front_ and rear_, 'above_ and 'below_ and the like are used as words of convenience to provide reference points and are not to be construed as limiting terms.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. For example, in this specification, the word 'comprising_ is to be understood in its 'open_ sense, that is, in the sense of 'including_, and thus not limited to its 'closed_ sense, that is the sense of consisting only of_. A corresponding meaning is to be attributed to the corresponding words 'comprise_, 'comprised_, 'comprises_, 'having_, 'has_, includes_, and 'including_ where they appear. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property can include additional elements not having that property. The term 'exemplary_ is intended to mean 'an example of._ The phrase 'one or more of the following: A, B, and C_ means 'at least one of A and/or at least one of B and/or at least one of C." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase 'means for_ followed by a statement of function void of further structure.

Although the terms 'step_ and/or 'block_ may be used herein to connote different elements of methods employed, the terms should not be interpreted as implying any particular order among or between various steps herein disclosed unless and except when the order of individual steps is explicitly described. The order of execution or performance of the operations in examples of the disclosure illustrated and described herein is not essential, unless otherwise specified. The operations may be performed in any order, unless otherwise specified, and examples of the disclosure may include additional or fewer operations than those disclosed herein. It is therefore contemplated that executing or performing a particular operation before, contemporaneously with, or after another operation is within the scope of aspects of the disclosure.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A reciprocating pump assembly comprising:

a first fluid end section having a first pressure chamber having an inlet valve and an outlet valve, and a first plunger bore that fluidly communicates with the first pressure chamber;

a first plunger rod assembly comprising a first plunger configured to be held within the first plunger bore of the first fluid end section;

a second fluid end section having a second pressure chamber having an inlet valve and an outlet valve, and a second plunger bore that fluidly communicates with the second pressure chamber;

a second plunger rod assembly comprising a second plunger configured to be held within the second plunger bore of the second fluid end section;

at least one linear actuator operatively connected to the first and second plunger rod assemblies such that the at least one linear actuator is configured to reciprocate the first and second plungers within the first and second plunger bores, respectively, during operation of the reciprocating pump to thereby pump fluid through the first and second fluid end sections; and a controller operatively connected to the at least one first linear actuator such that the controller is configured to electronically control the at least one first linear actuator such that acceleration of the first plunger and acceleration of the second plunger are controlled to provide a substantially constant combined flow rate of fluid through the first and second fluid end sections, wherein the combined flow rate of fluid through the first and second fluid end sections has a variation of less than 5% compared to an average combined flow rate of fluid through the first and second fluid end sections.

2. The reciprocating pump assembly of claim 1, wherein the at least one linear actuator comprises at least one of a mechanical linear actuator, an electrical linear actuator, an electro-mechanical linear actuator, a magnetic linear actuator, a hydraulic linear actuator, a pneumatic linear actuator, a screw-type actuator, a ball screw, a lead screw, a rotary screw, a screw jack, a roller screw, a hydraulic piston, a linear motor, a wheel and axle actuator, a telescoping linear actuator, a solenoid, or a servo.

3. The reciprocating pump assembly of claim 1, further comprising at least one driver configured to drive operation of the at least one linear actuator, the driver comprising at least one of an engine, an electrical motor, a turbine, a hydraulic pump, a pneumatic pump, a mechanical pump, an electrical power source, an electrical circuit, a processor, a mechanical drive system, a pneumatic system, or a hydraulic system.

4. The reciprocating pump assembly of claim 1, further comprising a power end section that comprises the at least one linear actuator.

5. The reciprocating pump assembly of claim 1, wherein at least one of the first fluid end section includes only a single one of the first pressure chamber or the second fluid end section includes only a single one of the second pressure chamber.

6. The reciprocating pump assembly of claim 1, wherein the first and second plunger rod assemblies are operatively connected to the at least one linear actuator such that the first and second plunger rod assemblies are coaxially aligned with each other.

7. The reciprocating pump assembly of claim 1, wherein the at least one linear actuator is configured to simultaneously move the first and second plunger rod assemblies in the same direction.

8. The reciprocating pump assembly of claim 1, wherein the at least one linear actuator is at least one first linear actuator, the reciprocating pump assembly further comprising:

a third fluid end section having a third pressure chamber and a third plunger bore that fluidly communicates with the third pressure chamber;

a third plunger rod assembly comprising a third plunger configured to be held within the third plunger bore of the third fluid end section;

a fourth fluid end section having a fourth pressure chamber and a fourth plunger bore that fluidly communicates with the fourth pressure chamber;

a fourth plunger rod assembly comprising a fourth plunger configured to be held within the fourth plunger bore of the fourth fluid end section; and at least one second linear actuator operatively connected to the third and fourth plunger rod assemblies such that the at least one second linear actuator is configured to reciprocate the third and fourth plungers within the third and fourth plunger bores, respectively, during operation of the reciprocating pump to thereby pump fluid through the third and fourth fluid end sections.

9. The reciprocating pump assembly of claim 1, wherein the combined flow rate of fluid through the first and second fluid end sections has a variation of less than 1% compared to the average combined flow rate of fluid through the first and second fluid end sections.

10. The reciprocating pump assembly of claim 1, wherein the at least one linear actuator is at least one first linear actuator, the reciprocating pump assembly further comprising:

a third fluid end section having a third pressure chamber and a third plunger bore that fluidly communicates with the third pressure chamber;

a third plunger rod assembly comprising a third plunger configured to be held within the third plunger bore of the third fluid end section;

a fourth fluid end section having a fourth pressure chamber and a fourth plunger bore that fluidly communicates with the fourth pressure chamber;

a fourth plunger rod assembly comprising a fourth plunger configured to be held within the fourth plunger bore of the fourth fluid end section;

at least one second linear actuator operatively connected to the third and fourth plunger rod assemblies such that the at least one second linear actuator is configured to reciprocate the third and fourth plungers within the third and fourth plunger bores, respectively, during operation of the reciprocating pump to thereby pump fluid through the third and fourth fluid end sections;

wherein the controller is operatively connected to the at least one second linear actuator such that the controller is configured to offset the duty cycle of the first and second fluid end sections from the duty cycle of the third and fourth fluid end sections and to electronically control the at least one second linear actuator such that acceleration of the third plunger and acceleration of the fourth plunger are controlled to provide a substantially constant combined flow rate of fluid through the first, second, third, and fourth fluid end sections.

11. A method for operating a reciprocating pump assembly comprising:

operatively connecting at least one linear actuator to a first plunger rod assembly of a first fluid end section having a first plunger bore and a first pressure chamber, the first pressure chamber having an inlet valve and an outlet valve;

operatively connecting the at least one linear actuator to a second plunger rod assembly of a second fluid end section having a second plunger bore and a second pressure chamber, the second pressure chamber having an inlet valve and an outlet valve, the inlet valve and the outlet valve coaxially aligned along a second fluid passage axis; and operatively connecting the at least one linear actuator to an electronic controller, the controller configured to electronically control the at least one linear actuator such that a duty cycle of the first fluid end section is offset from a duty cycle of the second fluid end section;

reciprocating respective first and second plungers of the first and second plunger rod assemblies within the first and second plunger bores, respectively, using the at least one linear actuator to pump fluid through the first and second fluid end sections; and electronically controlling the at least one linear actuator by the electronic controller to control acceleration of the first plunger and acceleration of the second plunger such that a combined fluid flow rate of the first fluid end section and the second fluid end section is substantially constant and has a variation of less than 5% compared to the average combined flow rate of fluid through the first and second fluid end sections.

12. The method of claim 11, wherein reciprocating the first and second plungers within the first and second plunger bores, respectively, using the at least one linear actuator comprises simultaneously moving the first and second plunger rod assemblies in the same direction.

13. The method of claim 11, wherein the at least one linear actuator is at least one first linear actuator, the method further comprising:

operatively connecting at least one second linear actuator to a third plunger rod assembly of a third fluid end section having a third plunger bore;

operatively connecting the at least one second linear actuator to a fourth plunger rod assembly of a fourth fluid end section having a fourth plunger bore;

reciprocating respective third and fourth plungers of the third and fourth plunger rod assemblies within the third and fourth plunger bores, respectively, using the at least one second linear actuator to pump fluid through the third and fourth fluid end sections; and offsetting the duty cycle of the first and second fluid end sections from the duty cycle of the third and fourth fluid end sections.

14. The method of claim 13, wherein the first plunger rod assembly, the second plunger rod assembly, the third plunger rod assembly, and the fourth plunger rod assembly each drives three plungers within their respective fluid ends, and wherein the combined flow rate of fluid through the first, second, third, and fourth fluid ends has a variation of less than 5% compared to an average combined flow rate of fluid through the first, second, third, and fourth fluid ends.

* * * * *